US010865534B2

(12) United States Patent
Martin et al.

(10) Patent No.: US 10,865,534 B2
(45) Date of Patent: Dec. 15, 2020

(54) SNOWPLOW WITH GROUND CONTOUR FOLLOWING CUTTING EDGE AND IMPACT ABSORPTION

(71) Applicant: 1708828 Ontario Limited, Listowel (CA)

(72) Inventors: Dale James Martin, Newton (CA); Chris Anthony Raben, Listowel (CA); Ryan Earl Frey, Listowel (CA)

(73) Assignee: 1708828 ONTARIO LIMITED, Listowel (CA)

( * ) Notice: Subject to any disclaimer, the term of this patent is extended or adjusted under 35 U.S.C. 154(b) by 211 days.

(21) Appl. No.: 16/183,090

(22) Filed: Nov. 7, 2018

(65) Prior Publication Data

US 2019/0136474 A1 May 9, 2019

(30) Foreign Application Priority Data

Nov. 7, 2017 (GB) ..... 1718420.1
Nov. 7, 2017 (GB) ..... 1718429.2
Nov. 7, 2017 (GB) ..... 1718430.0

(51) Int. Cl.
*E01H 5/06* (2006.01)
*E02F 3/815* (2006.01)

(52) U.S. Cl.
CPC ..... *E01H 5/066* (2013.01); *E01H 5/061* (2013.01); *E01H 5/062* (2013.01)

(58) Field of Classification Search
CPC . E01H 5/061–063; E01H 5/066; E02F 3/8152
See application file for complete search history.

(56) References Cited

U.S. PATENT DOCUMENTS 520,479 A 5/1894 Bunnell
2,778,129 A 1/1957 Freyer
(Continued)

FOREIGN PATENT DOCUMENTS

CA 2423830 2/2004
CA 2717986 9/2009
(Continued)

OTHER PUBLICATIONS

CTC & Associates LLC, "Clear Roads: Multipl-Blade Snowplow Project Final Report" Dec. 30, 2010.
(Continued)

*Primary Examiner* — Tara Mayo-Pinnock
(74) *Attorney, Agent, or Firm* — Bereskin & Parr LLP

(57) ABSTRACT

A cutting edge system for a snowplow is described herein. The system includes a backing plate coupled to a bottom portion of a moldboard of the snowplow and a plurality of cutting edge segments mounted to a front surface of the backing plate. Each cutting edge segment includes a blade segment slidably mounted to the front surface of the backing plate. Each blade segment has a lower portion configured to engage a ground surface, an upper portion having an uppermost edge opposed to the cutting edge, and two upwardly extending lobes spaced apart from each other to define an intermediate portion therebetween. Each cutting edge segment also includes a compression member configured to be retained in between the uppermost edge of the intermediate portion and an engaging surface of the backing plate. The compression member is configured to absorb upward movement of the blade segment when the cutting edge engages the ground surface.

20 Claims, 19 Drawing Sheets

(56) References Cited

U.S. PATENT DOCUMENTS

| | | | |
|---|---|---|---|
| 3,798,805 | A | 3/1974 | Hancock |
| 3,994,081 | A | 11/1976 | Middleton |
| 4,288,932 | A | 9/1981 | Kuper |
| 4,635,387 | A | 1/1987 | Haring |
| 4,669,205 | A | 6/1987 | Smathers |
| 4,794,710 | A | 1/1989 | Haring |
| 5,437,113 | A | 9/1995 | Jones |
| 5,697,172 | A | 12/1997 | Verseef |
| 5,743,032 | A | 4/1998 | Vauhkonen |
| 5,746,017 | A | 5/1998 | Marvick |
| 5,819,443 | A | 10/1998 | Winter |
| 6,073,371 | A | 6/2000 | Goos et al. |
| 6,125,559 | A | 10/2000 | Mullenhour |
| 6,618,965 | B1 | 9/2003 | Schultz et al. |
| 6,701,646 | B2 | 3/2004 | Schultz et al. |
| 6,823,615 | B2 | 11/2004 | Strait |
| 6,922,924 | B2 | 8/2005 | Jones et al. |
| 7,107,709 | B2 | 9/2006 | Hamel |
| 7,143,531 | B2 | 12/2006 | Micozzi |
| 7,159,344 | B2 | 1/2007 | Karhi |
| 7,171,770 | B2 | 2/2007 | Schultz et al. |
| 7,467,485 | B2 | 12/2008 | Lachance et al. |
| 7,555,853 | B2 | 7/2009 | Paonessa |
| 7,631,441 | B2 | 12/2009 | Hunt |
| 7,975,407 | B2 | 7/2011 | Paonessa |
| 2,698,744 | A1 | 10/2011 | Vigneault |
| 8,191,287 | B2 | 6/2012 | Winter et al. |
| 8,602,122 | B2 | 12/2013 | Congdon et al. |
| 8,776,405 | B2 | 7/2014 | Paonessa |
| 9,121,151 | B2 | 9/2015 | Bergeron et al. |
| D781,352 | S | 3/2017 | Hunt |
| 9,611,604 | B2 | 4/2017 | Vigneault |
| 2003/0182824 | A1 | 10/2003 | Coffin et al. |
| 2004/0231201 | A1 | 11/2004 | Hamel |
| 2009/0282706 | A1 | 11/2009 | Barker et al. |
| 2011/0314708 | A1 | 3/2011 | Paonessa |
| 2013/0037287 | A1 | 2/2013 | Hall |
| 2016/0040379 | A1 | 2/2016 | Vigneault |
| 2017/0218585 | A1 | 8/2017 | Vigneault |

FOREIGN PATENT DOCUMENTS

| | | |
|---|---|---|
| CA | 2698744 | 10/2011 |
| CA | 2625016 | 5/2013 |
| CA | 2796157 | 8/2013 |
| CA | 2856940 | 7/2017 |
| DE | 1299675 | 7/1969 |
| DE | 3205974 | 9/1983 |
| EP | 1557494 | 7/2007 |
| EP | 2271807 | 8/2017 |
| GB | 886572 | 1/1960 |

OTHER PUBLICATIONS

Henderson Manufacturing Inc., "RSP Reversible Plow" Brochure Dec. 2017.

Bonnell Industries Inc., "High Country Tortion Trip Snow Plow" Brochure 0306 www.bonnell.com 2006.

CTRE "Improving Snow Plow Design: Highway Maintenance Concept Vehicle Phase V" Apr. 2006.

Arctic Incorporated Snow, Sectional Sno-Plow Apr. 1, 2009.

JOMA 6000 Product Information From Black Cat Blades. [online]. www.jomablackcat.com, Jan. 10, 2006 [retrieved on Aug. 7, 2020]. Retrieved from <https://web.archive.org/web/20060110235636/http://www.jomablackcat.com:80/products/products.html>. (3 pages).

JOMA 6000 From Black Cat Blades. The Revolutionary New Method of High Speed Snow Removal.[online]. www.jomablackcat.com, May 13, 2006 [retrieved on Aug. 7, 2020]. Retrieved from <https://web.archive.org/web/20060513193346/http://www.jomablackcat.com/>. (1 page).

Black Cat Blades//JOMA 6000. Flyer [online]. wwww.crdcreighton.com [retrieved on Aug. 7, 2020]. Retrieved from <http://www.crdcreighton.com/wp-content/uploads/joma6000-Flyer.pdf>. (1 page).

SNOWPLOW WITH GROUND CONTOUR FOLLOWING CUTTING EDGE AND IMPACT ABSORPTION

CROSS-REFERENCE TO RELATED APPLICATIONS

The present application claims priority to GB Application No. 1718420.1 filed on Nov. 7, 2017 and entitled SNOWPLOW WITH GROUND CONTOUR FOLLOWING CUTTING EDGE, GB Application No. 1718429.2 filed on Nov. 7, 2017 entitled SNOWPLOW WITH GROUND CONTOUR FOLLOWING CUTTING EDGE, and GB Application No. 1718430.0 filed on Nov. 7, 2017 entitled IMPACT ABSORBTION, the entire contents of which are hereby incorporated by reference in their entirety.

TECHNICAL FIELD

The embodiments disclosed herein relate to snowplows and, in particular, to snowplows with cutting edge assemblies that follow ground contours.

BACKGROUND

Snowplow blades are typically mounted directly to a front of a vehicle to remove debris such as dirt, snow and/or ice from a ground surface directly in front of the vehicle when the vehicle is in motion. Factors such as the type of ground surface the blade is used on, the frequency of usage of the blade and a user's ability to operate the vehicle may cause damage to the blade that results in a need to replace part or all of the lowermost cutting edge of the plow blade.

Several different mechanisms have been developed in attempts to prevent damage to snowplow blades that is caused by the blade engaging the ground surface during use or striking an obstruction.

For example, some current snowplow blades have solid upper moldboards and lower cutting edges that include individual cutting edge segments that are separately removable and replaceable. The individual cutting edge segments may also provide for the lowermost cutting edge of the plow blade to contour to uneven ground surfaces. This is generally accomplished by biasing the lowermost cutting edge of each individual cutting edge segment to engage the ground surface and then providing for each individual cutting edge segment to move vertically relative to the upper moldboard of the plow blade.

For instance, in one example, U.S. Pat. No. 5,746,017 describes a ploughshare having cutting edges and a securing device for attachment to a plough. The ploughshare has a number of individual metallic shares which are firmly embedded in an elastomer mass. During use, each individual share is independently moveable from the underlying surface against the elasticity in the mass with a view to absorbing or adjusting itself to irregularities in the underlying surface. The share is mounted substantially vertical and is especially designed for equipment for clearing snow, slush and ice.

In another example, U.S. Pat. No. 7,631,441 describes a wearing edge attachment system that includes at least one wearing edge, a flexible device adapted to surround and engage a portion of the wearing edge and a fastening device. During use, the wearable edge is movable upwardly against the flexible device to adjust to surface contours. The fastening device secures the flexible device and the wearing edge to a snowplow.

Another mechanism currently used includes a moldboard and a trip edge coupled to a bottom portion of the moldboard. The trip edge is designed to be pivotally movable in a backwards direction relative to a moldboard of the plow blade when the trip edge strikes an obstruction.

U.S. Pat. No. 9,611,604 describes a trip edge used in combination with individual cutting edge segments that are independently vertically movable relative to the ground. Specifically, U.S. Pat. No. 9,611,604 describes a scraper blade device for cleaning a surface, for instance a roadway surface, when moving in a forward direction relative to the surface. The scraper blade device includes an upper blade portion and a bottom blade portion. The bottom blade portion has a plurality of widthwise-disposed blade segments that are adjoined and juxtaposed to one another. The bottom edge of each blade segment is independently slidingly movable in an up and down movement out of alignment with reference to the bottom edge of the other blade segments and is biased towards a downward working direction. The bottom edge of the blade segments is also pivotally movable with reference to the surface to be cleaned about a pivot axis that is substantially parallel to the lowermost edge of the scraper blade device. The bottom edges is biased towards a forward working position.

To provide for each blade segment to be independently slidingly movable in an up and down movement out of alignment with reference to the bottom edge of the other blade segments, U.S. Pat. No. 9,611,604 describes a plurality of spring mechanisms, each spring mechanism cooperating with a single one of the blade segments to urge the blade segment downwardly against the surface.

While the prior art movable cutting edge systems tend to do a better job of removing snow from uneven surfaces than conventional snowplows with a fixed cutting edge, there remains a need for improved cutting edge systems that enable the cutting edge to contour to uneven ground surfaces.

SUMMARY

According to one aspect, a cutting edge system for a snowplow is described herein. The system includes a backing plate coupled to a bottom portion of a moldboard of the snowplow; and a plurality of cutting edge segments configured to be mounted to the front surface of the backing plate, each cutting edge segment comprising: a blade segment configured to be slidably mounted to the front surface of the backing plate, the blade segment having: a lower portion having a cutting edge configured to engage a ground surface, and an upper portion having an uppermost edge opposed to the cutting edge, and two upwardly extending lobes spaced apart from each other to define an intermediate pocket portion therebetween, each of the two lobes having a slot configured to receive a fastener to slidably mount the blade segment to the backing plate; a compression member configured to be retained in between the uppermost edge of the intermediate pocket portion and an engaging surface of the backing plate, the compression member being configured to absorb upward movement of the blade segment when the cutting edge engages the ground surface; and a retainer plate configured to be mounted to the backing plate and cover at least a portion of the blade segment when the blade segment is mounted to the backing plate.

The compression member may have a top portion, a bottom portion opposed to the top portion and two opposed side portions extending between the top and bottom portions, each side being configured to engage a portion of the blade segment.

The engaging surface may be a tab extending outwardly from the backing plate and the top portion of the compression member is configured to engage the tab The blade segment may include a lower flat bar tab coupled to the upper portion of the blade segment and the bottom portion of the compression member is configured to engage the lower flat bar tab.

At least a portion of an uppermost edge of the intermediate portion may be parallel with the tab of the backing plate.

The uppermost edge of the intermediate portion may extend along a width of the blade segment between the two slots.

The uppermost edge of the intermediate portion may be parallel with the cutting edge.

The two slots may be spaced apart from each other along a width of the blade segment and each slot has a perimeter that is greater than a perimeter of a respective fastener.

The two slots may have a height that is greater than a height of its respective fastener to provide for upward movement of the blade segment relative to the backing plate when the cutting edge engages the ground surface.

The system may also include a plurality of bushings, each bushing configured to engage a respective fastener within one of the slots and extend outwardly beyond a front surface of the blade segment when the blade segment is slidably mounted to the backing plate.

The cutting edge segment may be horizontally spaced from an adjacent cutting edge segment and each slot has a width that is greater than a width of each fastener and bushing when the fastener and bushing are received in the slot to provide for each blade segment to be pivotable about at least one of the fasteners.

At least a portion of an inner side of each slot may extend inwardly towards an opposed slot to provide for the width of the slot to be greater than the width of each fastener and bushing when the fastener and bushing are received in the slot.

The retainer plate may include two apertures spaced apart from each other along a width of the retainer plate.

Each aperture of the retainer plate may be co-axial with one of the slots of the blade segment.

The backing plate may include a plurality of openings, each opening positioned rearwardly of one of the compression members and below the tab of the backing plate.

The backing plate may be pivotally coupled to the bottom portion of the moldboard and configured to rotate rearwardly upon the snowplow blade striking an obstruction during operation.

The backing plate may include a right backing plate segment and a left backing plate segment, each backing plate segment being independently rotatable in a rearward direction upon the snowplow striking an obstruction during operation.

According to another aspect, a cutting edge segment configured to be mounted to a front surface of a backing plate of a snowplow is described herein. The cutting edge segment includes a blade segment configured to be slidably mounted to the front surface of the backing plate, the blade segment having: a lower portion having a cutting edge configured to engage a ground surface, and an upper portion having an uppermost edge opposed to the cutting edge, and two upwardly extending lobes spaced apart from each other to define an intermediate pocket portion therebetween, each of the two lobes having a slot configured to receive a fastener to slidably mount the blade segment to the backing plate; a compression member configured to be retained in between the uppermost edge of the intermediate pocket portion and an engaging surface of the backing plate, the compression member being configured to absorb upward movement of the blade segment when the cutting edge engages the ground surface; and a retainer plate configured to be mounted to the backing plate and cover at least a portion of the blade segment when the blade segment is mounted to the backing plate.

According to another aspect, a snowplow is described herein. The snowplow includes a moldboard; a backing plate coupled to a bottom portion of the moldboard; and a plurality of cutting edge segments configured to be mounted to the front surface of the backing plate, each cutting edge segment comprising: a blade segment configured to be slidably mounted to the front surface of the backing plate, the blade segment having: a lower portion having a cutting edge configured to engage a ground surface, and an upper portion having an uppermost edge opposed to the cutting edge, and two upwardly extending lobes spaced apart from each other to define an intermediate pocket portion therebetween, each of the two lobes having a slot configured to receive a fastener to slidably mount the blade segment to the backing plate; a compression member configured to be retained in between the uppermost edge of the intermediate pocket portion and an engaging surface of the backing plate, the compression member being configured to absorb upward movement of the blade segment when the cutting edge engages the ground surface; and a retainer plate configured to be mounted to the backing plate and cover at least a portion of the blade segment when the blade segment is mounted to the backing plate.

DETAILED DESCRIPTION

Various systems and methods will be described below to provide an example of each claimed embodiment. No embodiment described below limits any claimed embodiment and any claimed embodiment may cover systems or methods that differ from those described below. The claimed embodiments are not limited to systems or methods having all of the features of any one systems or methods described below or to features common to multiple or all of the systems or methods described below.

Ground contour following cutting edge systems that include a plurality of independently movable cutting edge segments slidably mounted to a backing plate along a bottom portion of a moldboard are described herein. The independently movable cutting edge segments are vertically independently movable relative to the backing plate to provide for a cutting edge of the system to adapt to uneven ground surfaces. The independently movable cutting edge segments each include a blade segment that directly engages with the ground surface when the system is in use. Each of the cutting edge segments also includes a compression member that biases a respective blade segment downwardly against the ground surface. The compression member is retained in between a tab extending outwardly from the backing plate and a portion of the cutting edge segment.

In the embodiments shown, the ground contour following cutting edge systems of the present invention are shown mounted on a snowplow blade that has a trip edge mechanism that includes a backing plate pivotally coupled to the bottom of the moldboard. The plurality of independently movable cutting edge segments are mounted on the backing plate. When the snowplow encounters large obstacles, the backing plate pivots backwardly. However, it should be understood that the system of the present invention could be mounted on a snowplow that does not include a trip edge mechanism.

Figure 1:
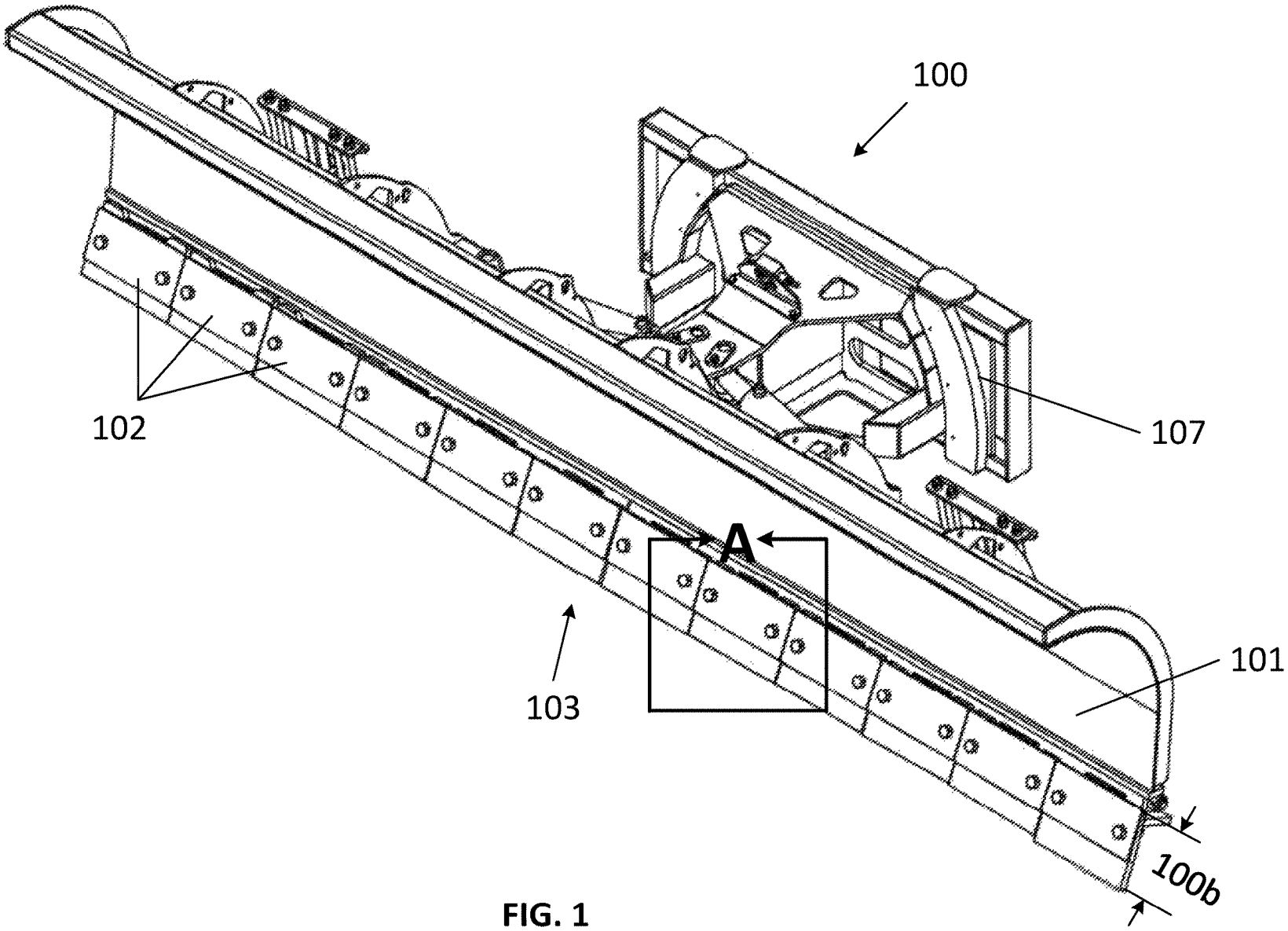
FIG. 1 is a front perspective view of a snowplow blade with a ground contour-following cutting edge, according to one embodiment.

Referring now to FIG. 1, illustrated therein is a perspective view of a snowplow blade 100 with a ground contour-following cutting edge system 103, according to one embodiment.

The terms "ground" or "ground surface" used herein are used in a generic manner. "Ground" or "ground surface" may include, for instance, roadway surfaces made of different materials such as asphalt, concrete, stones, gravel, earth, or the like. "Ground" or "ground surfaces" may include roads for vehicles, parking lots, airport runways, sidewalks, or the like.

The snowplow blade 100 shown in FIG. 1 is a moldboard-type plow including a moldboard 101 and a ground contour following cutting edge system 103 having a plurality of independently movable cutting edge segments 102. Moldboard 101 is generally constructed of a strong, high impact material, such as steel, in order to prevent damage to the snowplow blade 100 during use. The plurality of cutting edge segments 102 are mounted to a backing plate 105. Snowplow blade 100 is generally connected to a vehicle (not shown) using a generic connection assembly, such as assembly 107.

In the embodiments shown in the Figures, the snowplow blade 100 also includes a trip edge mechanism 200. Trip edge mechanism 200 provides for backing plate 105 to be pivotally movable relative to the moldboard 101 to protect a cutting edge 114 of the snowplow blade 100 from damage, particularly damage caused by striking a large obstruction (e.g. a manhole). Specifically, trip edge mechanism 200 is configured to rotate backing plate 105 rearwardly about an axis AA that is substantially parallel to cutting edge 114 (see FIGS. 2A to 2D) upon snowplow blade 100 striking a large obstruction.

Trip edge mechanism 200 includes one or more spring assemblies 201 for biasing the backing plate 105 forwardly into a working (e.g. operating) position (as shown in FIGS. 1 to 3A). Each spring assembly 201 includes one or more springs 214 secured to a portion of the moldboard 101, a trip lever 212 and a trip rod 210. The one or more springs 214 bias the trip lever 212 downwardly to bias the backing plate 105 into the working position.

Figure 2A:
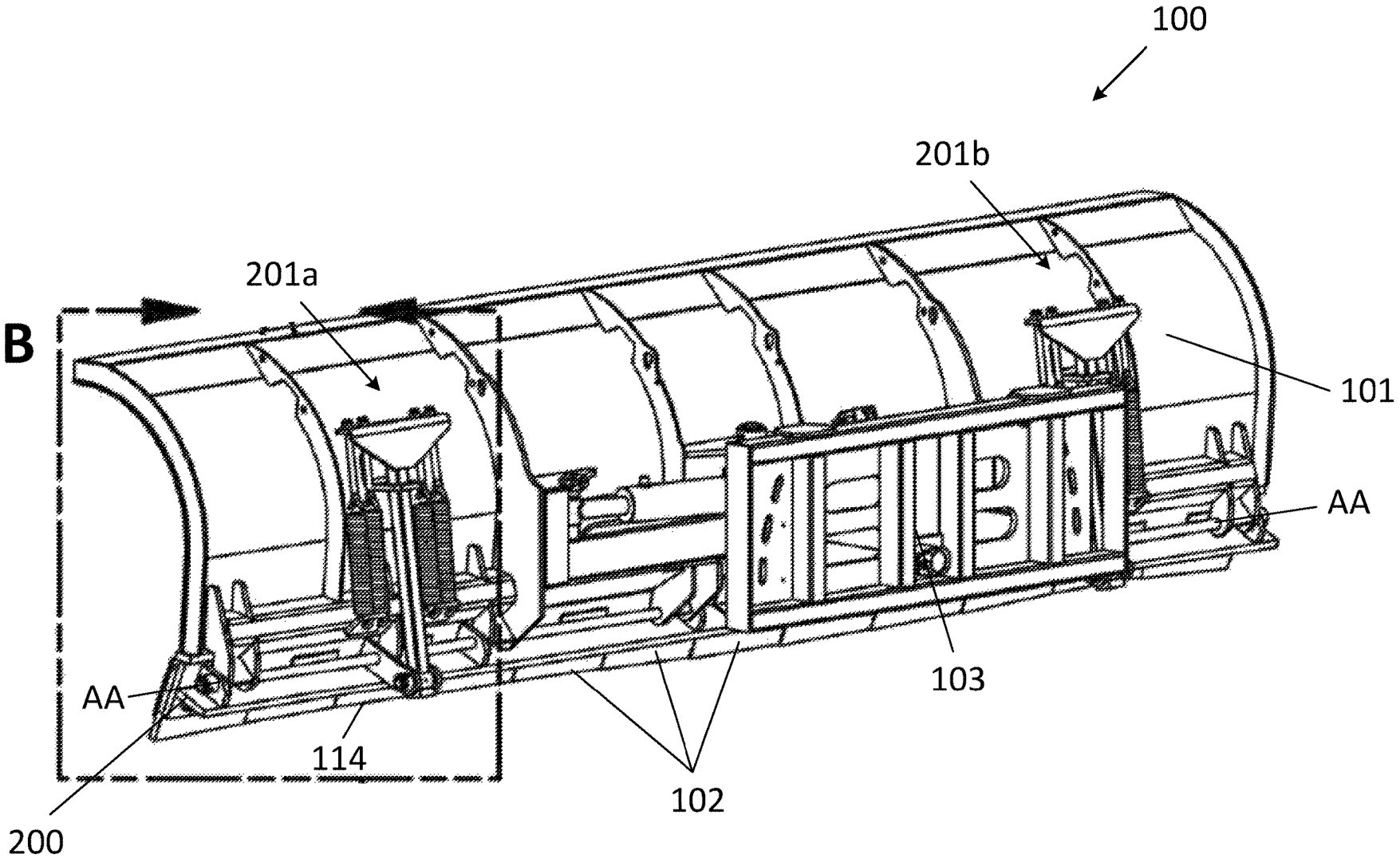
FIG. 2A is a rear perspective view of the snowplow blade with a ground contour-following cutting edge of FIG. 1.
Figure 2B:
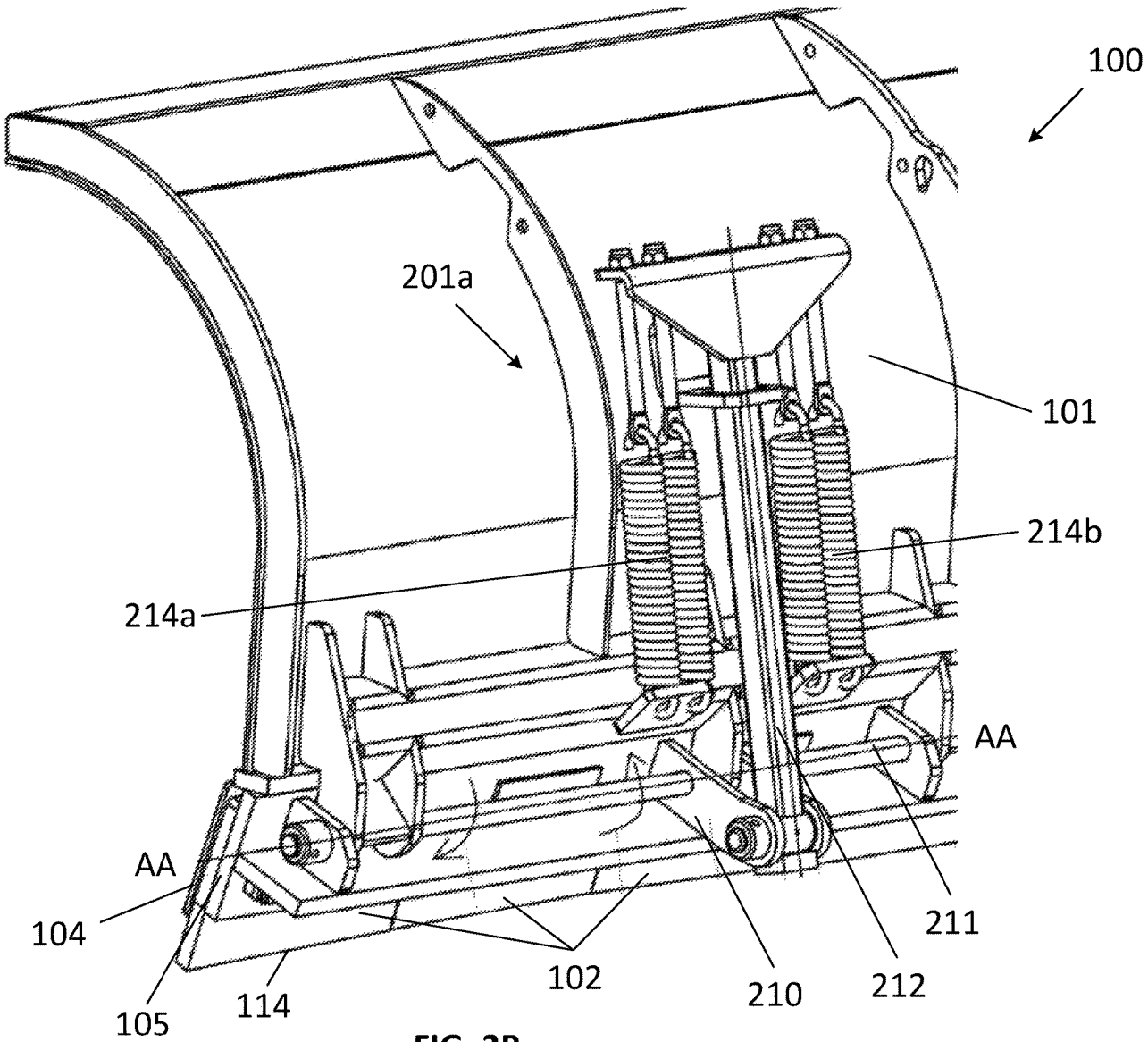
FIG. 2B is a magnified view of the portion B of the snowplow blade shown in FIG. 2A.
Figure 2C:
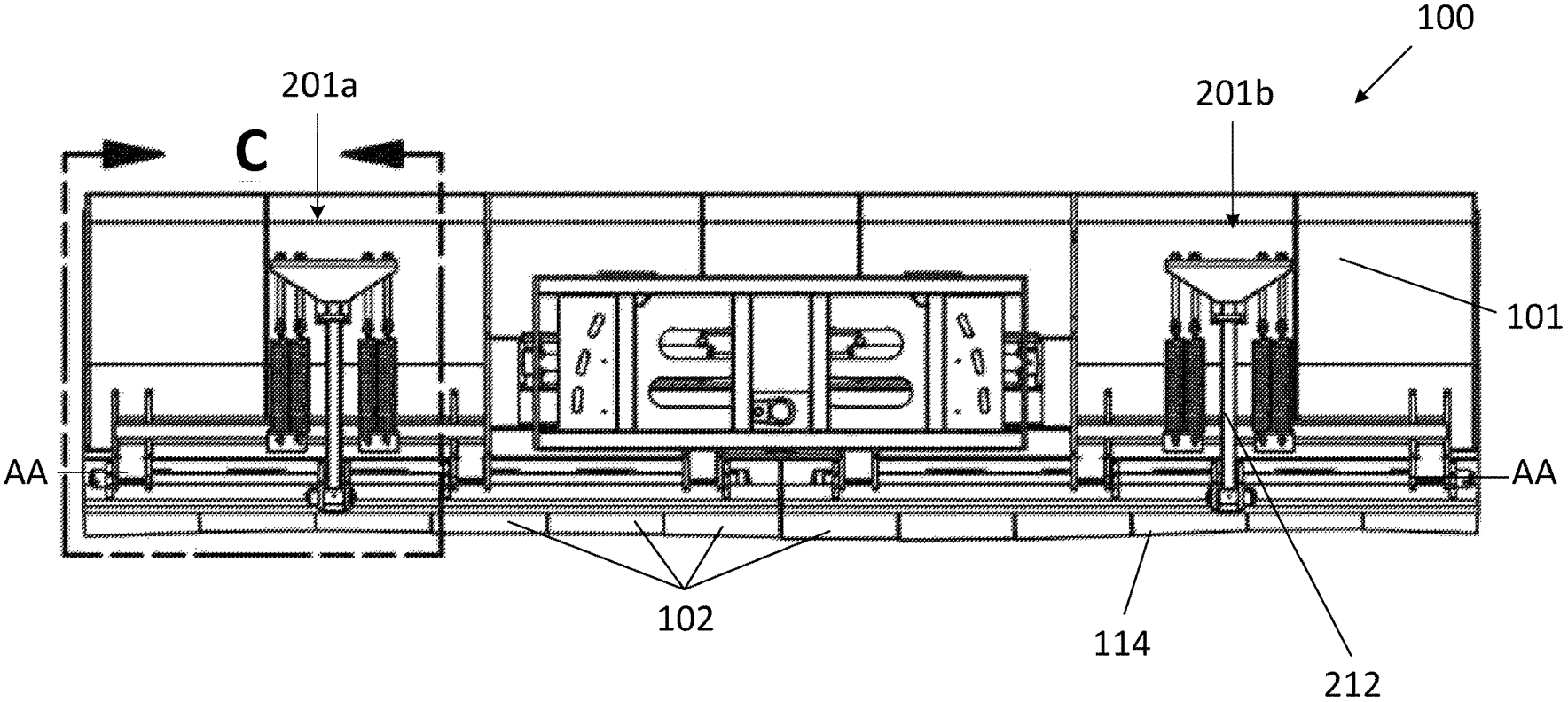
FIG. 2C is a rear view of the snowplow blade with a ground contour-following cutting edge of FIG. 1.
Figure 2D:
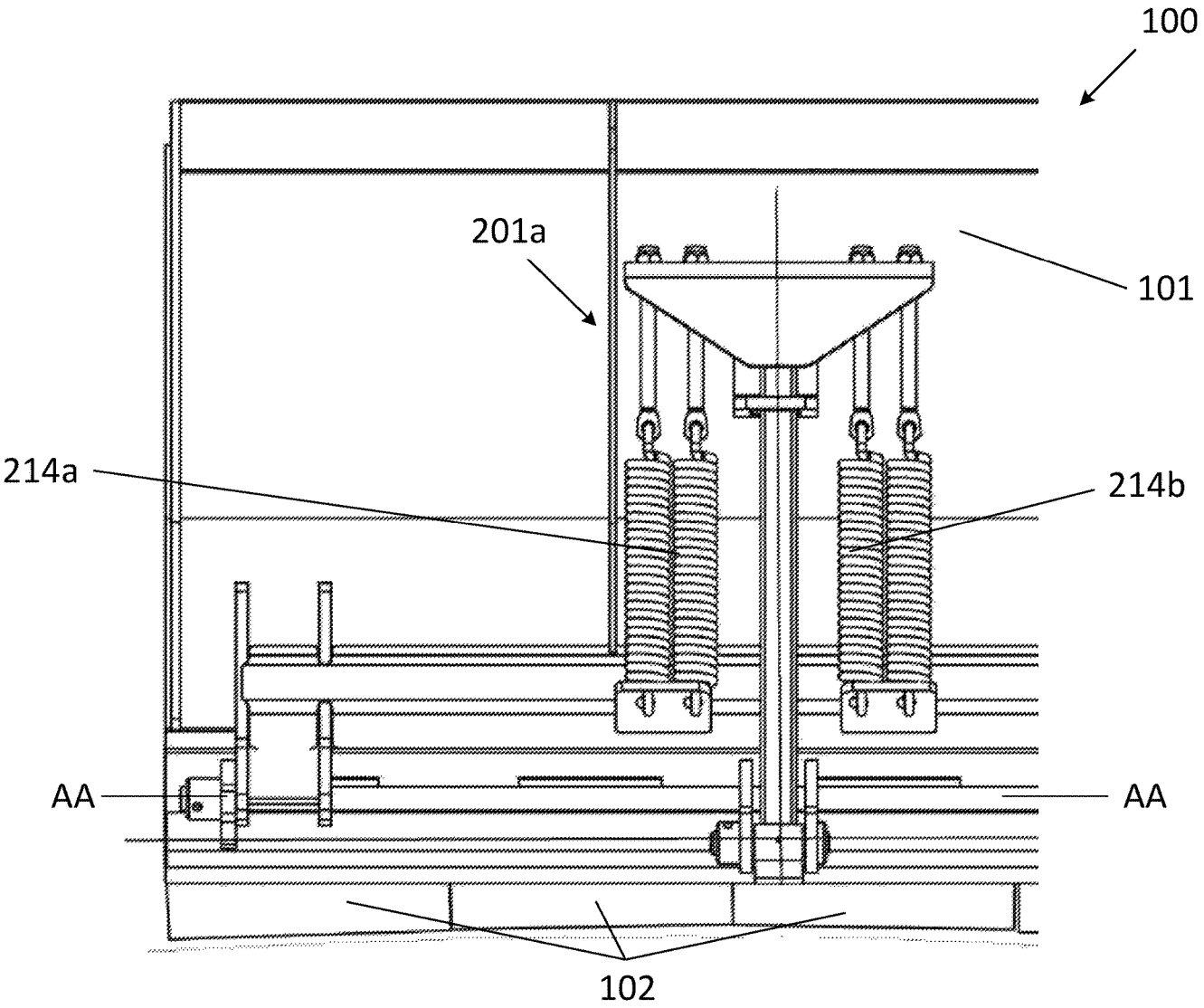
FIG. 2D is a magnified view of the portion C of the snowplow blade shown in FIG. 2C.
Figure 3A:
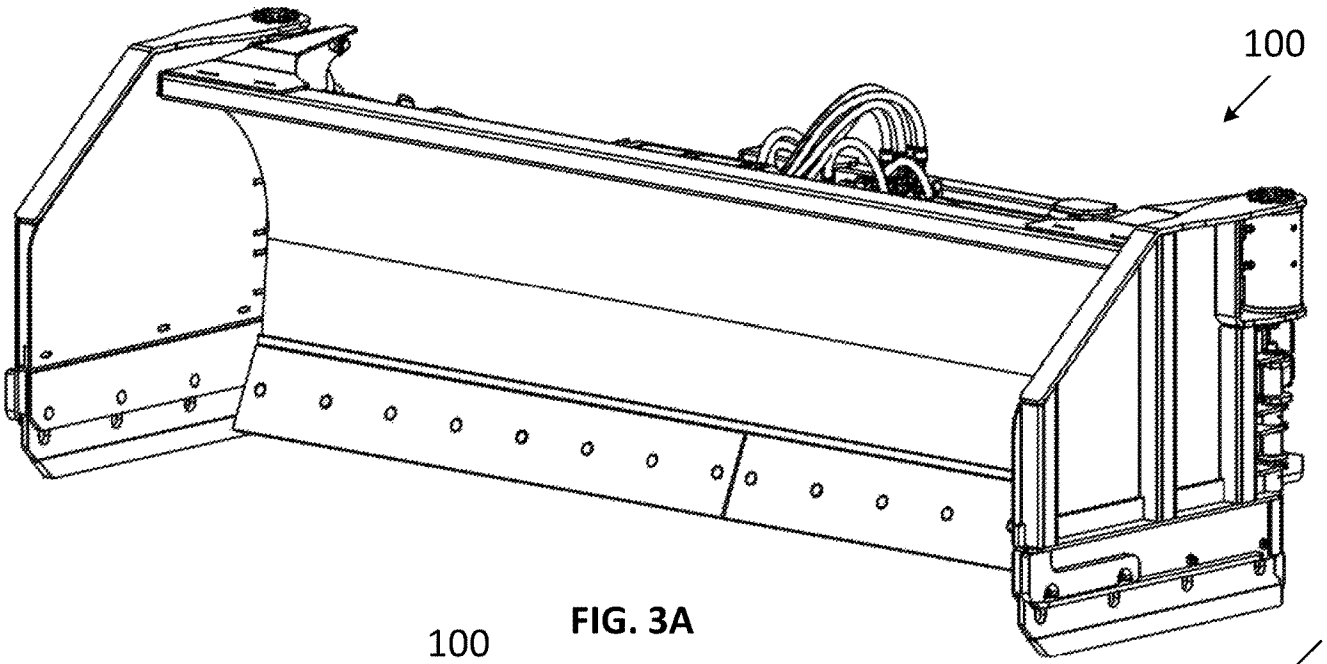
FIG. 3A is a front perspective view of a snowplow blade according to one embodiment with a trip edge in a working position.
Figure 3B:
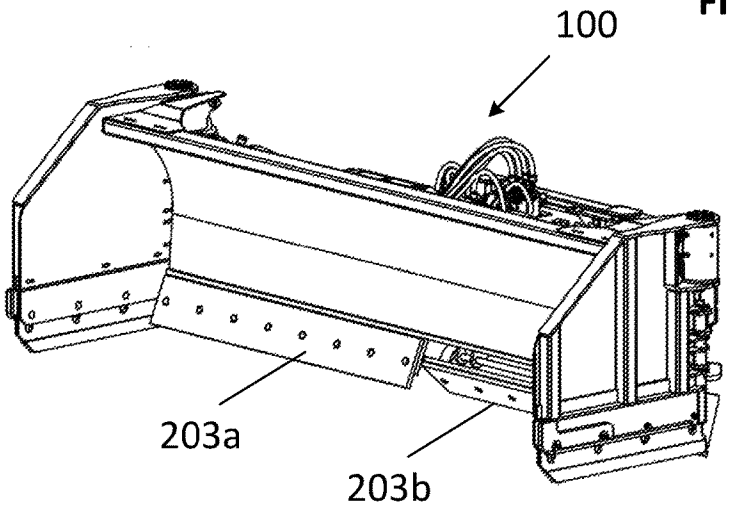
FIGS. 3B and 3C are right-side and left-side front perspective views, respectively, of the snowplow blade of FIG. 3A showing a segment of the trip edge being tripped to a non-working position.
Figure 3C:
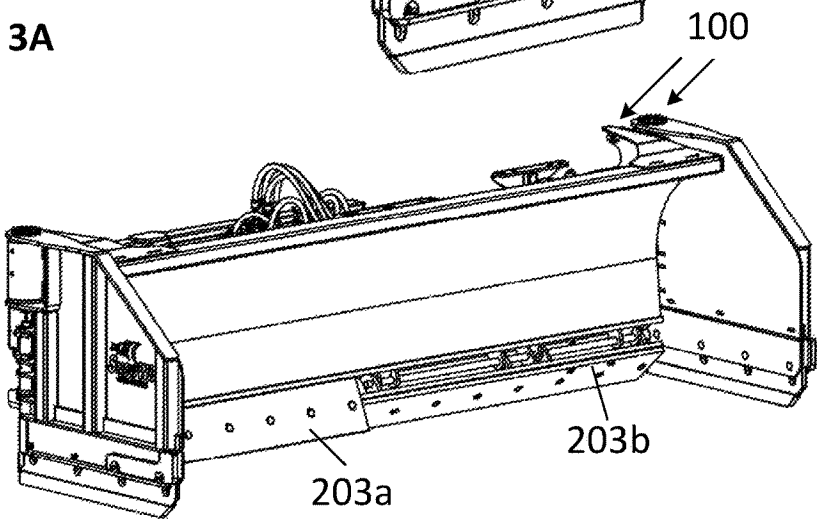

In the embodiment shown in the Figures, each spring assembly 201 includes a first pair of springs 214*a* and a second pair of springs 214*b* to bias trip lever 212 and backing plate 105. Trip lever 212 rotationally couples to trip rod 210 which is fixedly coupled to a trip bar 211 extending along a width of a respective trip segment 203. As snowplow blade 100 strikes an obstruction, trip assembly 201 is driven rearwardly from a working position to a non-working (e.g. non-operating) position, as shown in FIGS. 3B and 3C, thereby forcing counterclockwise rotation of trip bar 211 (as shown in FIG. 2B). Counterclockwise rotation of 211 provides for trip rod 210 to lift trip lever 212 vertically, which expands each pair of springs 214*a* and 214*b*. To return the trip edge 200 to the working position, a downward force is applied to the trip lever 212 by the pairs of springs 214*a* and 214*b* to rotate the trip bar 211 in a clockwise direction to and bias the trip edge 220 forward.

In the embodiment shown in the Figures, trip edge mechanism 200 includes two trip segments 203. FIGS. 3A to 3C shown snowplow blade 100 including left and right trip segments 203*a* and 203*b*, respectively. Each trip segment 203 includes a backing plate 105 coupled to a spring assembly 201. Spring assembly 201 provides for each trip segment 203 to independently rotate about axis AA. As shown in FIGS. 2A to 2D, in view of FIGS. 3A to 3C, spring assembly 201*a* provides for trip segment 203*b* to rotate about axis AA and spring assembly 201*b* provides for trip segment 203*a* to rotate about axis AA. It should be understood that trip edge mechanism may include a single trip segment extending across a width of the snowplow blade or, alternatively, may include more than two trip segments.

Figure 4:
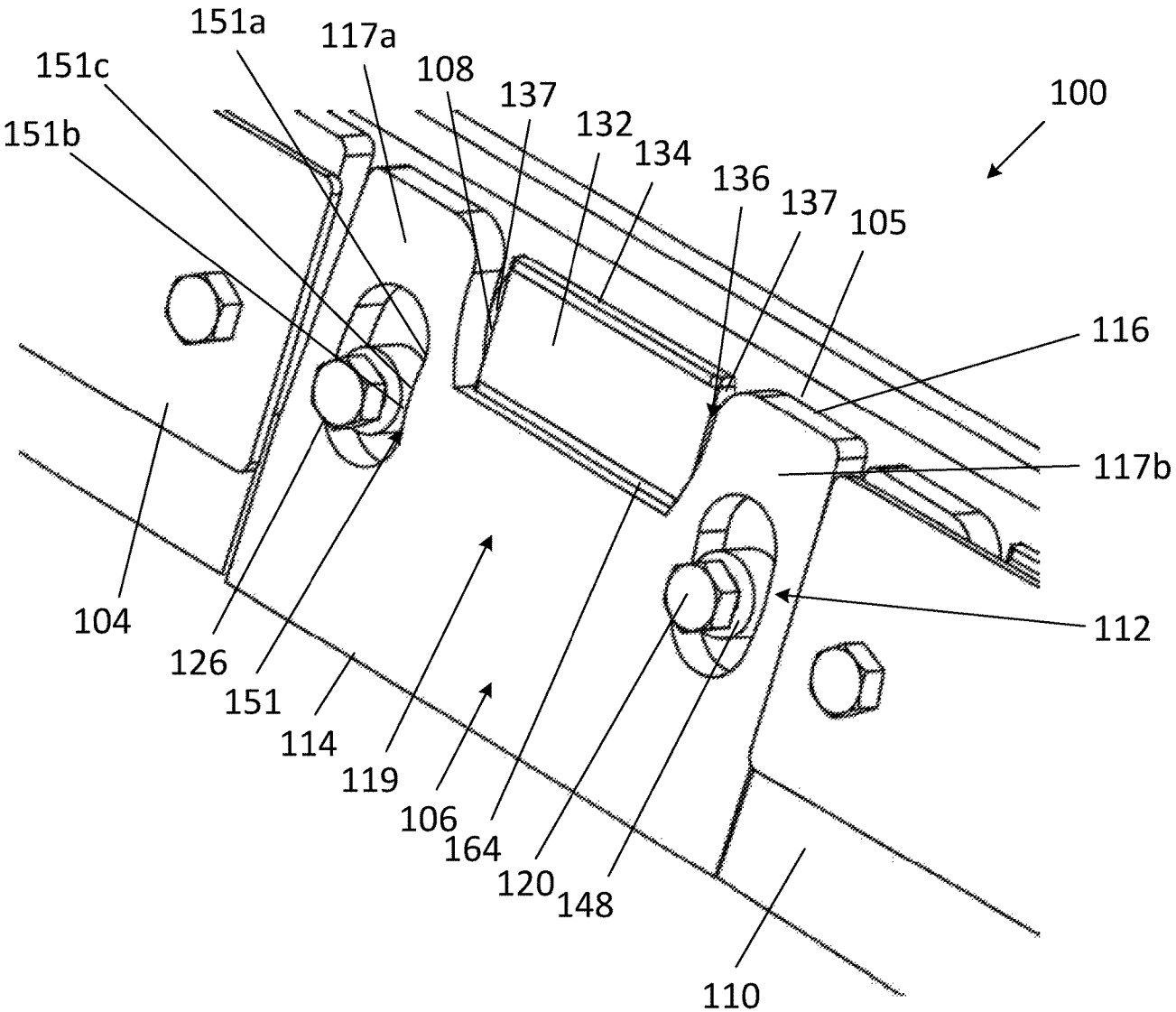
FIG. 4 is a magnified view of the portion A of the snowplow blade shown in FIG. 1, with the retainer plate removed.
Figure 5:
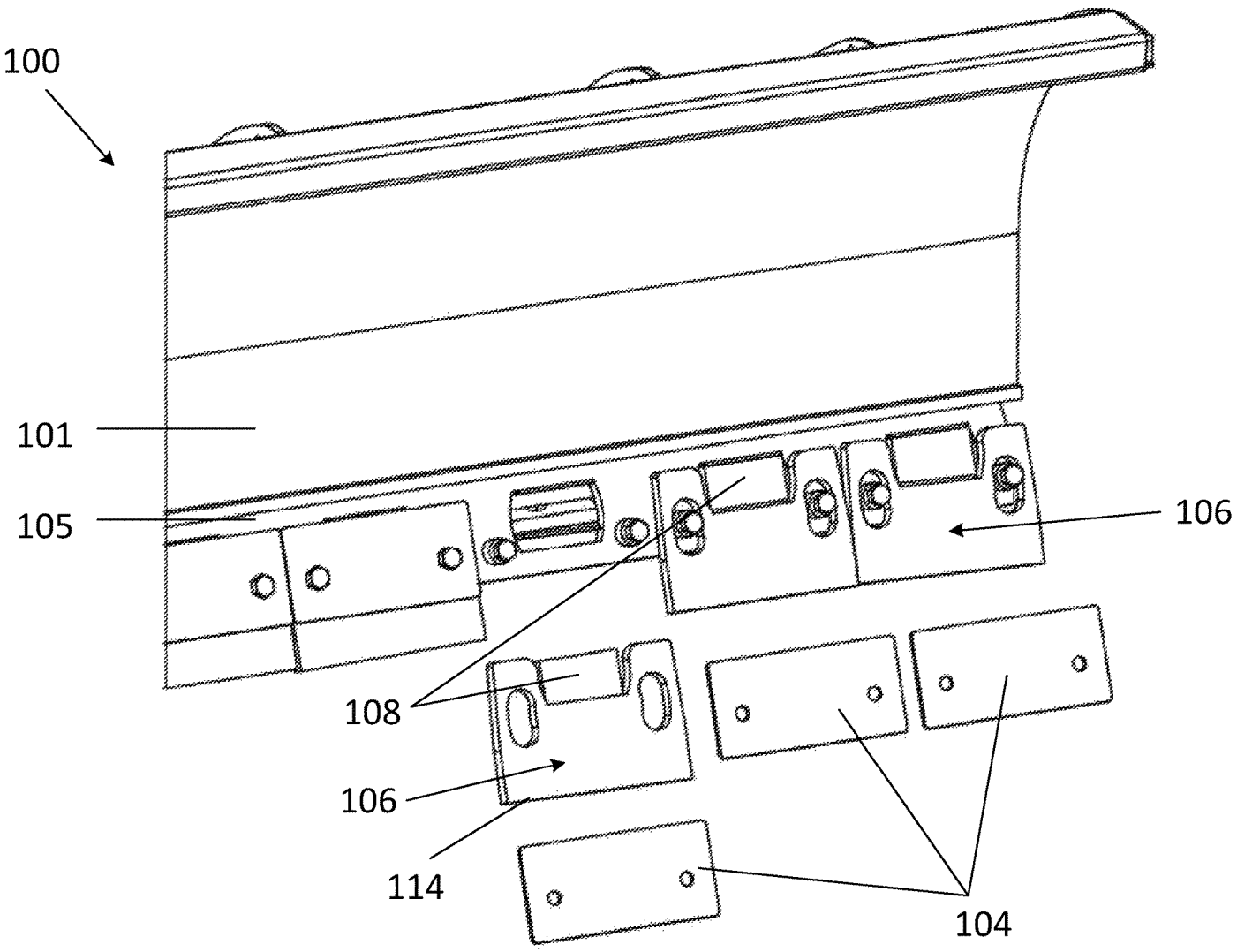
FIG. 5 is an exploded view of a plurality of blade segments of the snowplow blade shown in FIG. 1, with the retainer plate removed.

Turning now to FIGS. 4 and 5, shown therein is a perspective view of a portion of a snowplow blade 100 having cutting edge segments 102 installed thereon. FIG. 5 shows an exploded view of three cutting edge segments 102. Each cutting edge segment 102 includes a retainer plate 104, a blade segment 106 and a compression member 108.

Blade segment 106 includes a lower portion 110 having a lowermost (i.e. cutting) edge 114 configured to engage a ground surface, and an upper portion 112 having an uppermost edge 116 opposed to the cutting edge 114. Lower portion 110 generally extends downwardly and is exposed below the retainer plate 104 when the blade segment 106 and the retainer plate 104 are mounted to backing plate 105. Similarly, when the blade segment 106 and the retainer plate 104 are mounted to backing plate 105, Upper portion 112 is generally positioned in between the retainer plate 104 and backing plate 105 when the retainer plate 104 is mounted to the backing plate 105.

Upper portion 112 of blade segment 106 has two upwardly extending lobes 117*a*, 117*b* spaced apart from each other to define a pocket 136 therebetween. Each of the two lobes 117*a*, 117*b* includes a slot 122 configured to receive a fastener 120 and at least one bushing 148 to slidably mount the blade segment 106 to the backing plate 105. Blade segment 106 also includes an intermediate portion 119 extending downwardly from the pocket 136 between slots 122.

Each slot 122 is shaped to provide for the blade segment 106 to slide freely relative to a fastener 120 and at least one bushing 148 surrounding fastener 120 when both the fastener 120 and the bushing 148 are received in the slot 122. Accordingly, each of the two slots 122 has a height $H_1$ that is greater than a height H2 of its respective fastener 120 and at least one bushing 148 surrounding fastener 120 when both the fastener 120 and the bushing 148 are received in the slot 122.

Slots 122 of the blade segment 106 are also shaped to have a width that is greater than a width of the fastener 120 and the at least one bushing 148 surrounding fastener 120 when both the fastener 120 and the bushing 148 are received in the slot 122 to provide for the blade segment 106 to pivot horizontally relative to the fasteners 120 (as described below).

Each slot 122 has a perimeter 124 that defines a shape of the slot 122. In some embodiments, perimeter 124 of each slot 122 of the blade segment 106 may have a generally oblong shape with rounded corners to provide for the blade segment 106 to slide and/or pivot relative to the fastener 120 and at least one bushing 148 received in each slot 122. Alternatively, perimeter 124 of each slot 122 may have dimensions that resemble a different shape, including but not limited to a shape resembling two semi-circles on opposite sides of a rectangle, an oval shape, an elliptical shape, a circle, a quatrefoil, a kidney shape, a peanut shape or the like. Alternatively, each slot 122 of the blade segment 106 may have a shape that allows the blade segments 106 to pivot as described below For example, each slot 122 may have an inner side 151 facing an opposing slot 122 of the same blade segment 106 that is curved such that at least a portion of the slot 122 extends inwardly towards its opposed slot 122 relative to other portions of the inner side 151. An example of this type of shape is shown in the Figures, particularly FIG. 4, where upper and lower portions 151*a* and 151*b*, respectively, of the inner side 151 of each slot 122 are curved and extend inwardly towards the opposed slot 122 relative to a medial portion 151*c* of the slot 122.

Each fastener 120 may be bolts, screws or the like that passes through one of the slots 122 to couple to the backing plate 105, or otherwise couple directly to the backing plate 105 (e.g. via threads in an aperture of the backing plate 105). In other embodiments, each fastener 120 may be a retaining member that is integral with the backing plate 105 and protrudes outwardly from a front face of the backing plate 105.

One or more bushings 148 generally surround each of the fasteners 120 and are shaped to be slightly smaller than the width of slot 22 to allow blade segment 106 to ride up and down (e.g. slide freely) within slot 122 as the blade segment 106 moves relative to the fastener 120 and bushing 148. Bushings 148 may be made of a strong, high impact material, such as steel. Each fastener 120 engages with at least one bushing 148 that is made of a strong, high impact material, such as steel within a slot 122. This bushing 148 extends outwardly beyond a front surface of the blade segment 106 when the blade segment 106 is slidably mounted to the backing plate 105 and is rigid to provide a spacing TT (see FIG. 11) between the retainer plate 104 and the blade segment 106 when the retainer plate 104 and the blade segment 106 are mounted to the backing plate 105. Spacing TT provides for the blade segment 106 to slide relative to the retainer plate 104.

Optionally, each fastener may also engage a second bushing (not shown) made of a compressible material such as but not limited to rubber that may compress under a force being imparted by the blade segment 106. In these embodiments, the second bushing may be a compressible bushing that surrounds the bushing 148 and may, together with spacing 130, provide for blade segments 106 to pivot horizontally and protect the fasteners 120 from the force exerted on the blade segment 106 by an obstacle. By compressing, the second bushing may also protect the fasteners 120 from forces exerted on the blade segment 106 by, for example, a large obstacle.

It should be understood that second bushing is not a required feature for blade segment 106 to pivot horizontally with respect to the backing plate 105 and/or the retainer plate 104. As noted above, as the snowplow blade 100 is pushed forward along an uneven ground surface, the contour of the ground surface changes. Referring to FIGS. 6 to 9B, each blade segment 106 is spaced from an adjacent blade segment 106 by a spacing 130 (see FIG. 6). Spacing 130 together with at least a portion of each slot 122 being wider than a width of the fastener 120 and bushing 148 provides for the cutting edge 114 of each blade segment 106 to slightly pivot horizontally about an axis extending in the direction of travel of the snowplow blade 100 to further provide for the cutting edge 114 to conform to a ground surface as the snowplow blade 100 is pushed along the ground surface. In some embodiments, spacing 130 together with at least a portion of each slot 122 being wider than a width of the fastener 120 and bushing 148 may provide for the cutting edge 114 of the cutting edge assemblies to pivot horizontally. Horizontal pivoting of the cutting edge may be, for example, up to a pivot angle (described below). As shown in FIGS. 8A and 8B, the blade segment 106 may have a pivot angle measured between a lowermost edge 144 of the backing plate 105 and the cutting edge 114 when the cutting edge 114 pivots about the fasteners 120. In some embodiments, the pivot angle may be about 5 degrees. In other embodiments, the pivot angle may be greater than about 5 degrees or less than about 5 degrees.

Figure 9A:
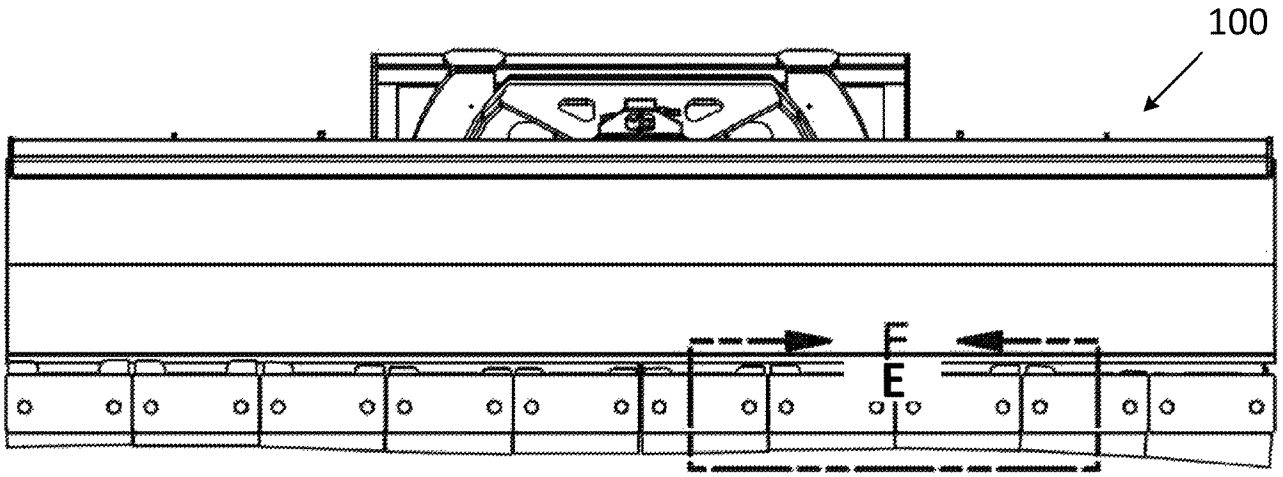
FIG. 9A a front view of the snowplow blade of FIG. 1 showing a bottom portion of the cutting edge following a ground contour, according to another embodiment.
Figure 9B:
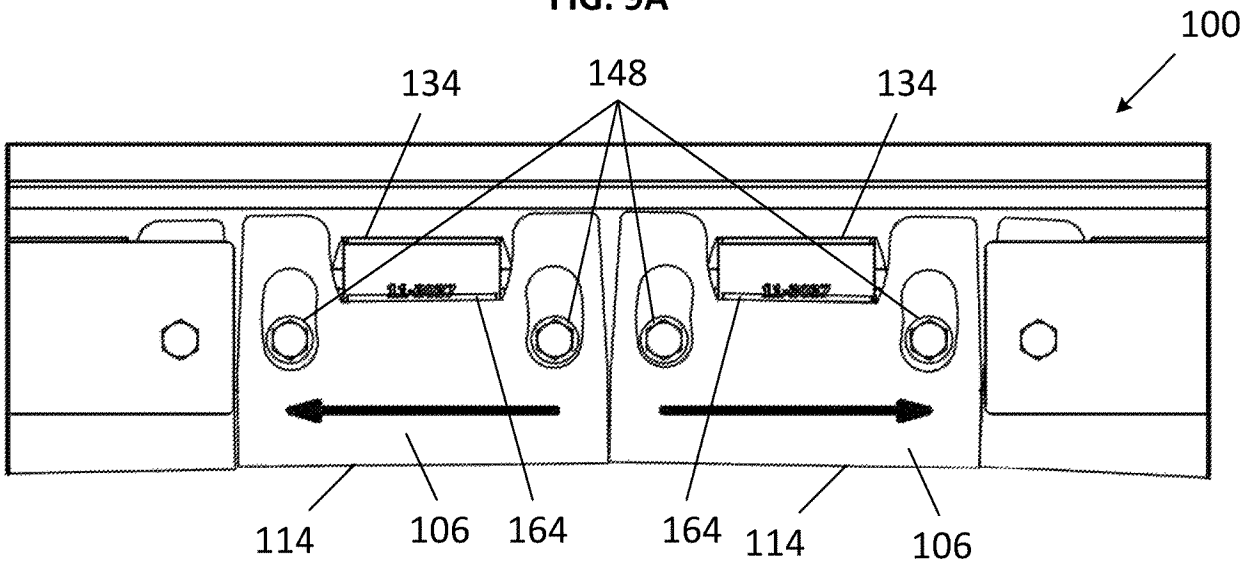
FIG. 9B is a close-up of the portion E of the snowplow blade shown in FIG. 9A showing with the retainer plate of two of the cutting edge assemblies removed to depict the pivotal movement of the cutting edges over a rise in the ground surface.

As shown in FIGS. 9A and 9B, adjacent blade segments 106 being able to horizontally pivot independently of each other may provide for adjacent corners of each cutting edge 114 to contact each other when the cutting edges 114 are engaging uneven surfaces. For particularly uneven surfaces, independent horizontal pivoting of blade segments 106 may provide for less ground material (e.g. snow) to escape between adjacent blade segments 106 than conventional snowplows with independently vertically slidable blade segments.

In some embodiments, slots 122 of the blade segment 106 may be co-axial with apertures 105 of the retainer plate 104 such that a single fastener 120 can pass through a slot 122 of the blade segment 106 and an aperture of the retainer plate 104 to mount both of the blade segment 106 and the retainer plate 104 to the backing plate 105.

Each cutting edge segment 102 also includes a compression member 108 configured to absorb upward movement of the blade segment 106 when the lower portion 110 of the blade segment 106 is engaging the ground surface. Compression member 108 biases (i.e. provides downward pressure) blade segment 106 to provide for cutting edge 114 to follow a contour of the ground surface. In the figures compression member 108 is shown as a rubber block having a rectangular shape. It should be understood that compression member 108 may also have a non-rectangular shape, such as but not limited to a square shape, a circular shape, an oblong shape, a triangular shape, or any other geometric shape that provides for compression member 108 to bias blade segment 106 downwardly and to absorb energy from upward movement of blade segment 106.

Compression member 108 is configured to engage at least a portion of the upper portion 112 of the blade segment 106. Compression member 108 includes a body 132 that is retained between the second portion 110 of the blade segment 106 and an engaging surface 134 of the backing plate 105. Engaging surface 134 is a rigid surface and is sized to engage with at least a portion of the compression member 108. Engaging surface 134 is generally an elongate surface that is transverse to an axis of travel of the blade segment 106. Engaging surface 134 limits vertical motion of the compression member 108 when the compression member 108 is acted upon by the blade segment 106. Specifically, engaging surface 134 inhibits vertical movement of the compression member 108 by receiving an upward force from the compression member 108 when the blade segment 106 slides upwardly relative to the backing plate 105 and impacts the compression member 108.

Figure 14B:
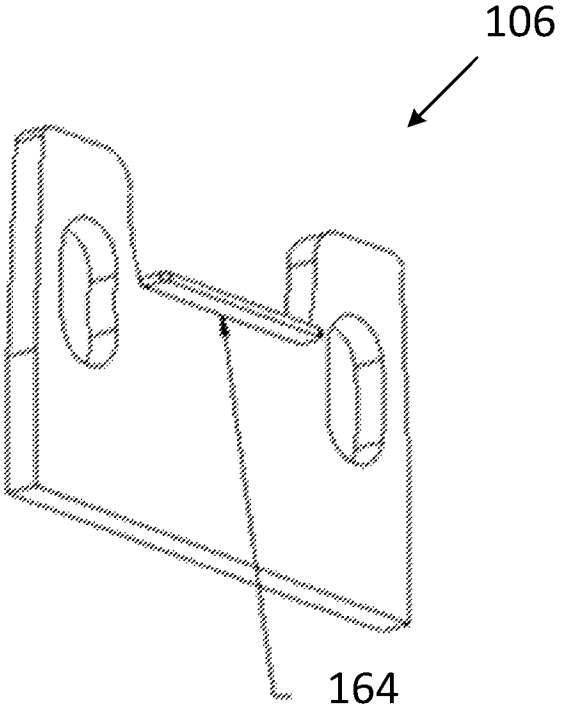
FIGS. 14A and 14B are perspective views of a blade segment having a lower flat bar tab, according to one embodiment.
Figure 14A:
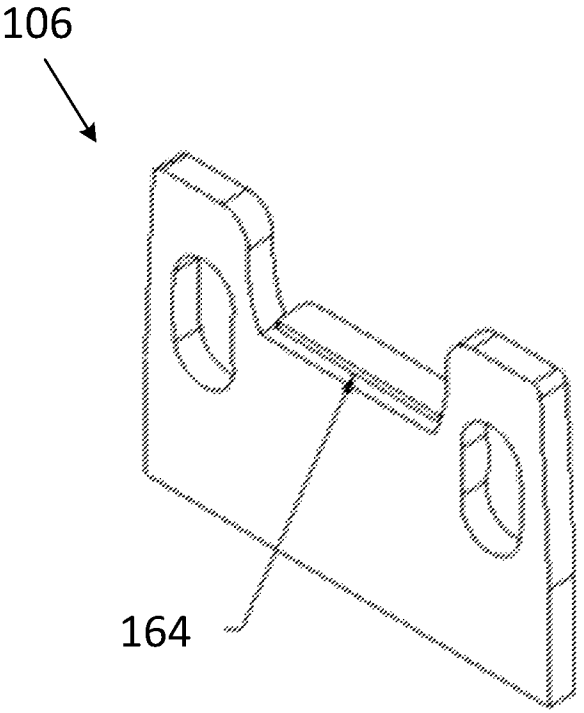

In the embodiments shown in the Figures, the compression member 108 is shaped to be at least partially received inside of pocket 136 and engages at least a portion of the blade segment 106. In some embodiments, a lower flat bar tab 164 may be coupled to an uppermost edge 116 of the intermediate portion 119 of the blade segment 106. This embodiment is shown in FIGS. 14A and 14B. Compression member 108 may be retained by the lower flat bar tab 164. In this configuration, each side 137 of the compression member 108 engages a portion of the blade segment 106, a top edge of the compression member engages the engaging surface 134 and a bottom edge of the compression member engages a portion of the blade segment 106.

Compression member 108 may be any appropriate compression member for biasing the blade segment 106 downwards. For instance, in the embodiments shown in the drawings, compression member 108 may be a rubber block. In these embodiments, a hardness of the compression member 108 may vary depending on a number of factors including but not limited to a weight of the snowplow blade and the end use of the snowplow. In some embodiments, the compression members may have a Shore A hardness in a range of about 5 to about 100, or in a range of about 20 to about 70, or in a range of about 35 to about 55, or in a range of about 40 to about 50, or of about 45.

Figure 14D:
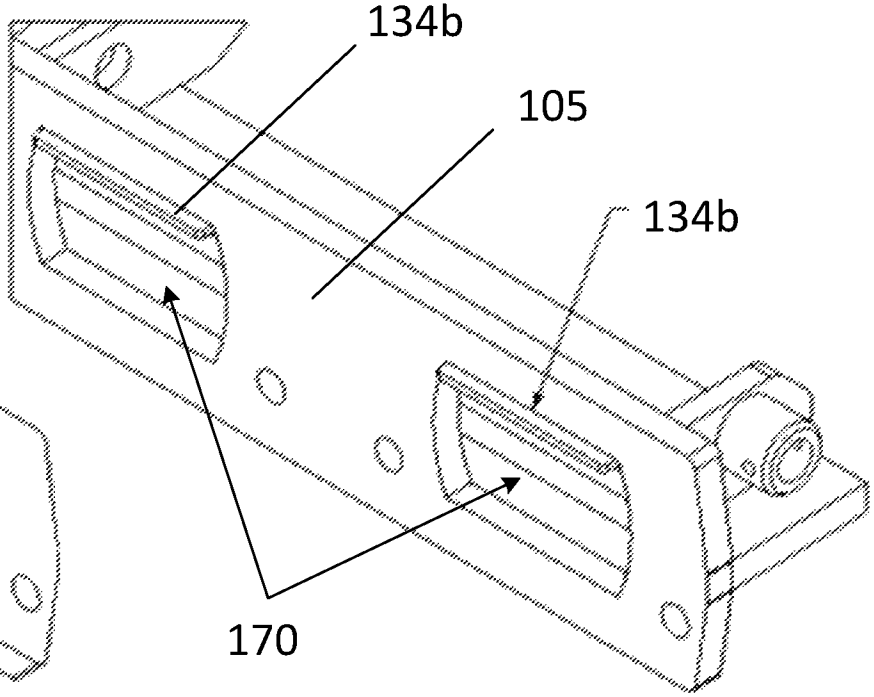
FIGS. 14C and 14D are rear and top front perspective views, respectively, of a portion of the backing plate, according to one embodiment.
Figure 14C:
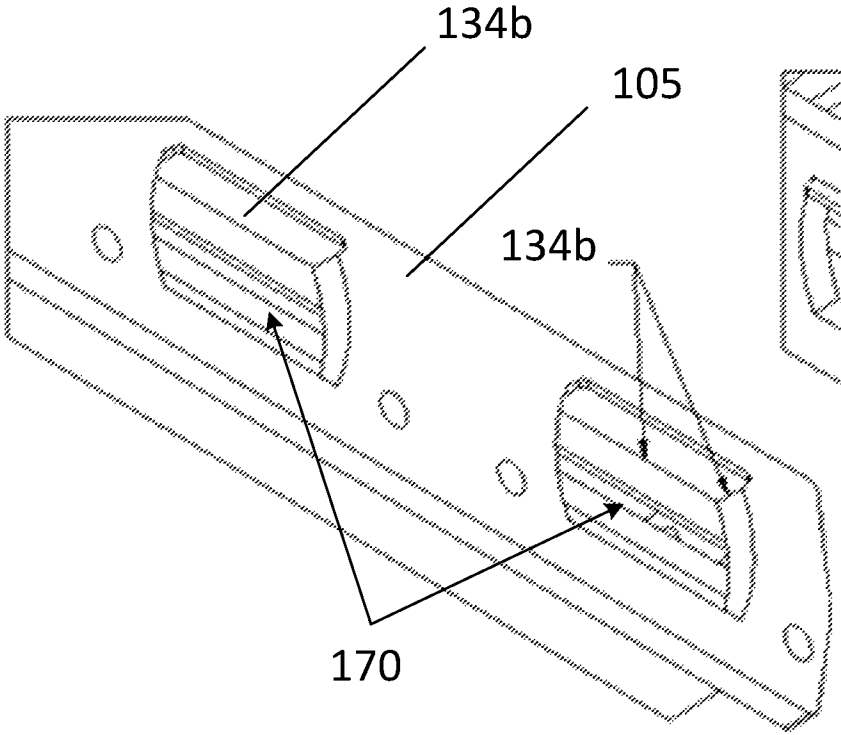

In some embodiments, engaging surface 134 is an upper tab 134*b*. Upper tab 134*b* may be integral with backing plate 105 or may be a separate component that is attached (e.g. welded) to backing plate 105. As shown in FIGS. 14C and 14D, in embodiments where backing plate 105 includes an opening 170 (further described below), upper tab 134*b* may be welded to an upper portion of the opening 170, extend outwardly from the front surface of the backing plate 105 and register with the compression member 108. For instance, upper tab 134*b* may extend outwardly from the front surface of the backing plate 105 in a direction towards the retainer plate 104 when the retainer plate 104 is mounted to the backing plate 105.

Retainer plate 104 of each cutting edge segment 102 is mounted on the backing plate 105, for instance by fasteners 120. Retainer plate 104 may include one or more apertures to provide for one or more fasteners 120 to be used to mount the retainer plate 104 to the backing plate 105.

Retainer plate 104 covers at least a portion of each blade segment 106 and is generally made of a strong, high impact material such as but not limited to steel to protect, for example, a front face of the blade segment 106 while the snowplow blade 100 is being used.

Figure 6:
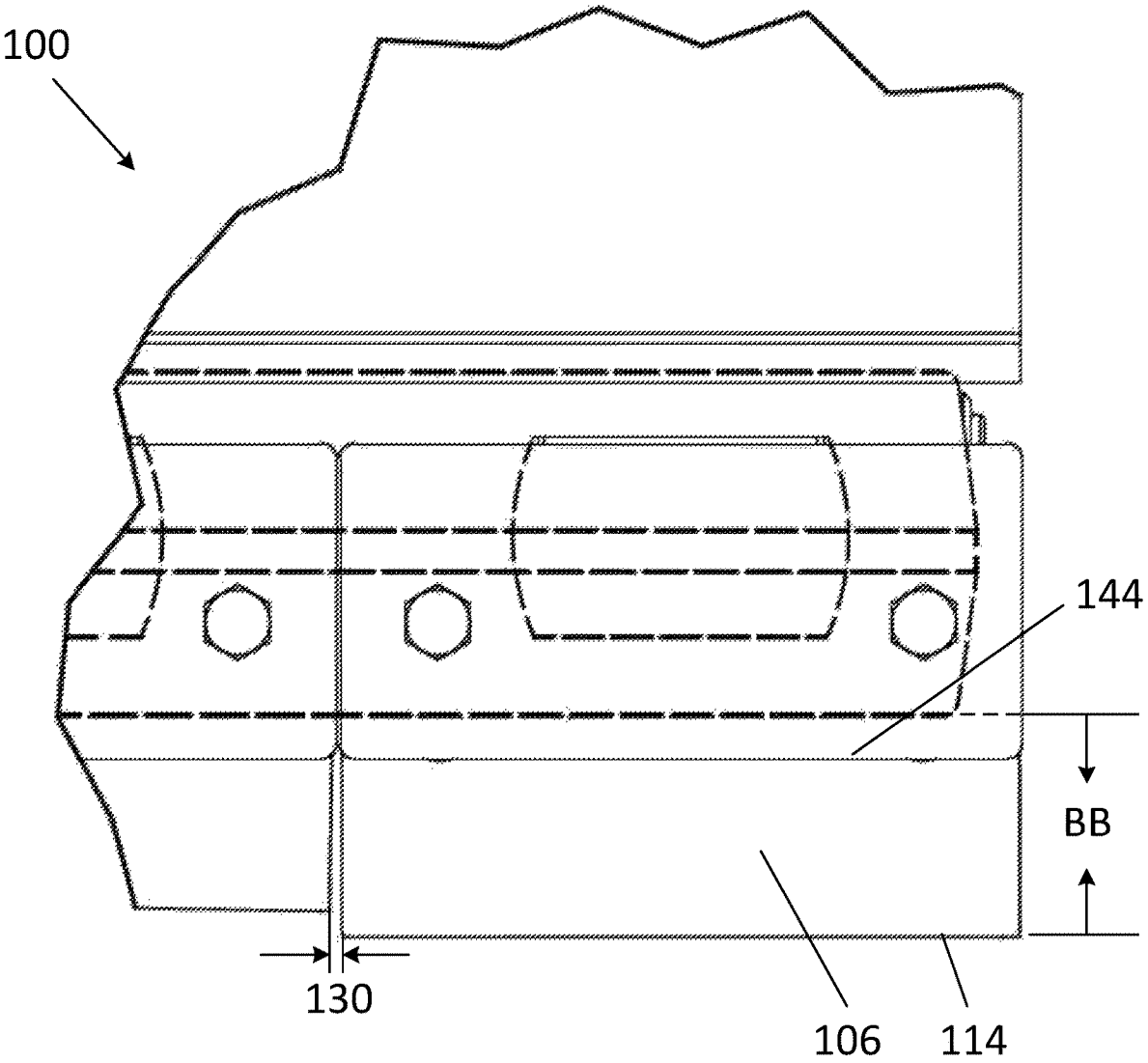
FIG. 6 is a magnified view of a portion of the snowplow blade shown in FIG. 1 showing a cutting edge assembly that is not contacting the ground surface.
Figure 7:
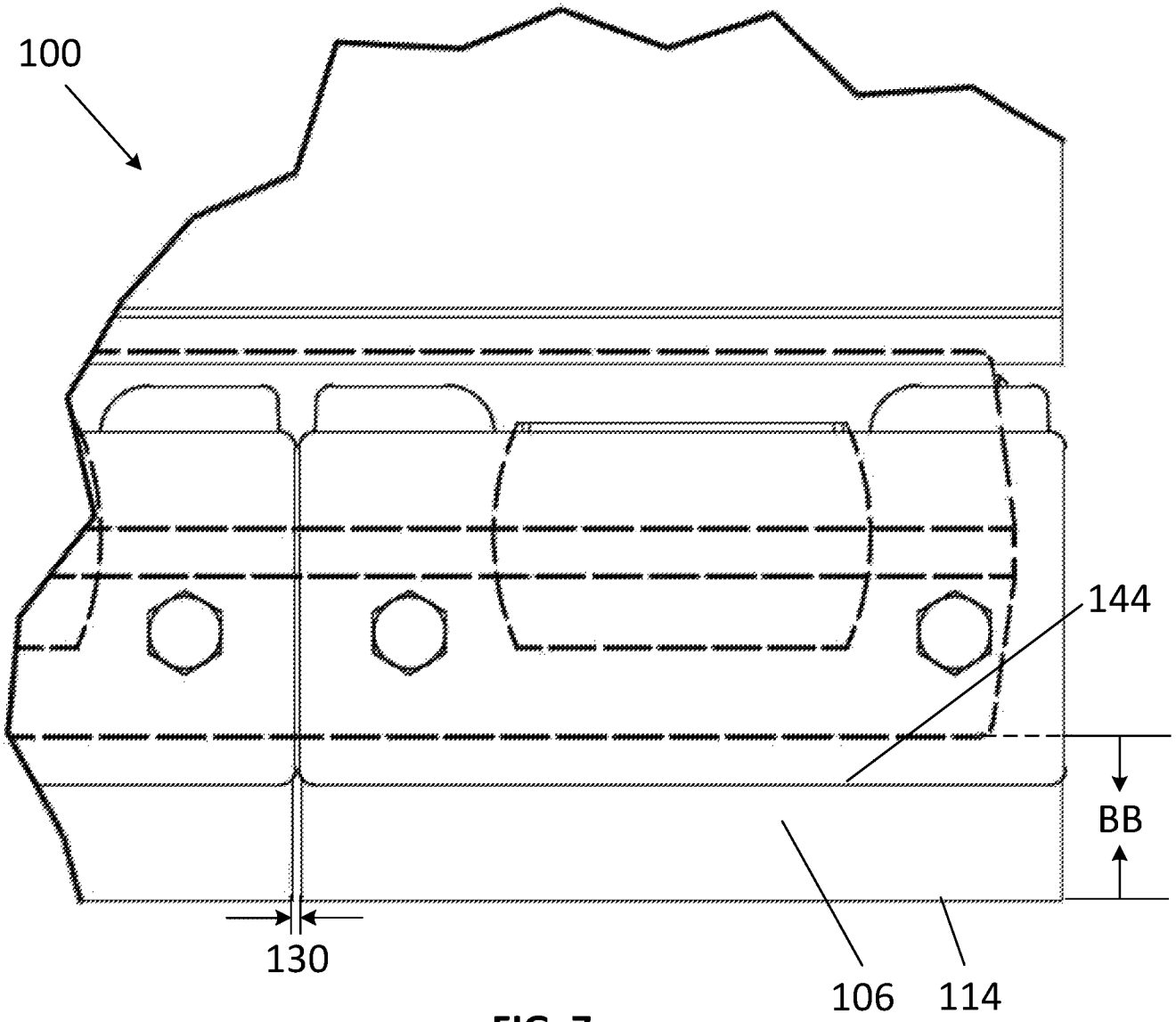
FIG. 7 is a magnified view of a portion of the snowplow blade shown in FIG. 1 showing a cutting edge assembly that is contacting the ground surface.
Figure 8A:
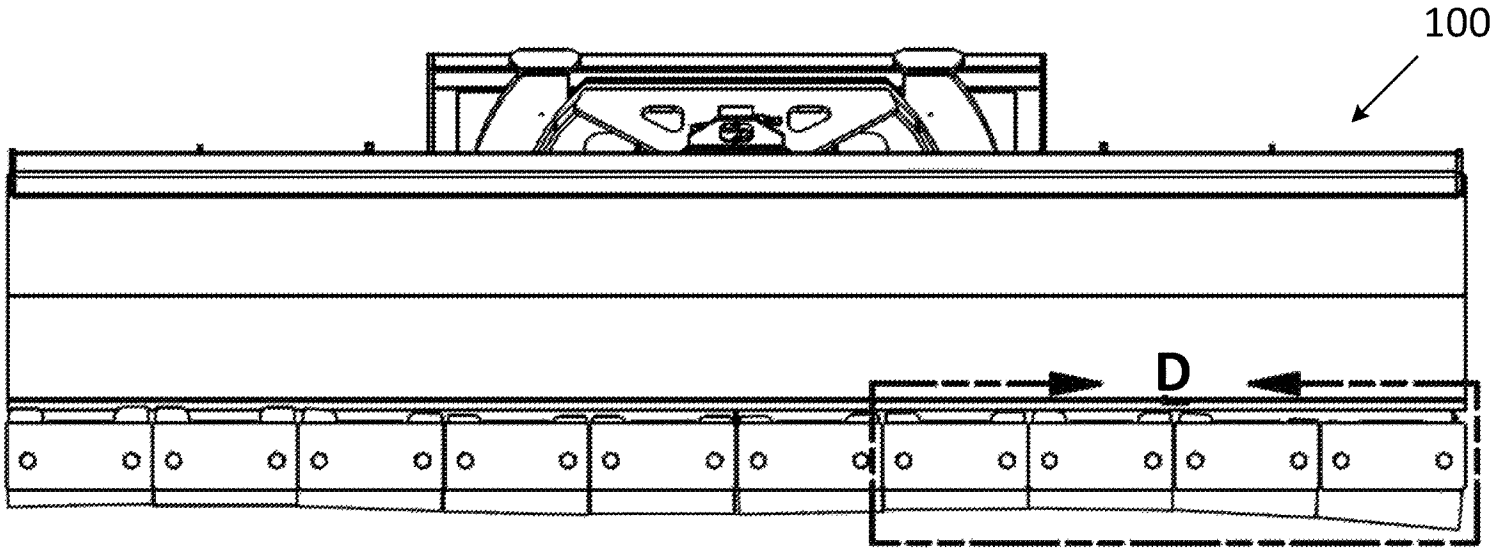
FIG. 8A is a front view of the snowplow blade of FIG. 1 showing a bottom portion of the cutting edge following a ground contour, according to another embodiment.
Figure 8B:
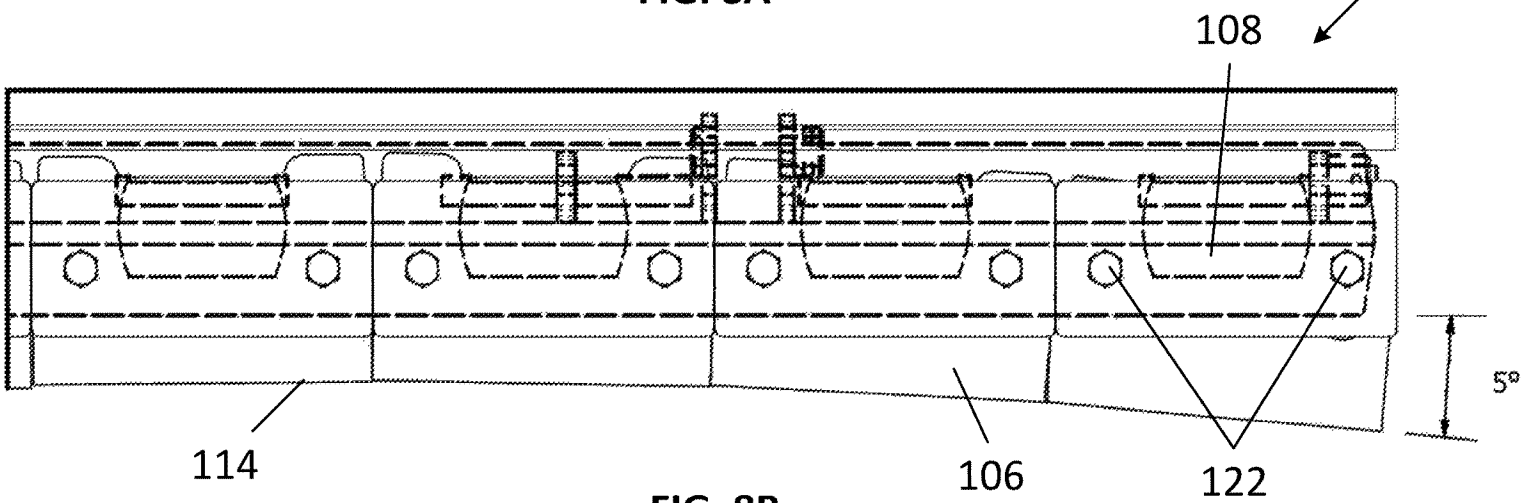
FIG. 8B is a magnified view of the portion D of the snowplow blade shown in FIG. 8A showing with the retainer plate of one of the cutting edge assemblies removed to depict the pivotal movement of the cutting edges over a rise in the ground surface.

Referring now to FIGS. 6 to 9B, illustrated therein are various front views of the snowplow blade 100 of FIG. 1 showing examples of how the snowplow blade 100 reacts to an uneven ground surface. For instance, referring to FIGS. 6 and 7, illustrated therein are front views of a portion of the snowplow blade 100 before and after it is lowered (e.g. by the vehicle) into an operating position, respectively.

In FIG. 6, the snowplow blade 100 is shown prior to being lowered into an operating position. In this view, the cutting edge 114 of the plow blade 100 is not engaged with the ground. Here, compression member 108 biases the blade segment 106 downward and the lower portion 110 of the blade segment 106 extends a distance BB below a lowermost edge 144 of backing plate 105. The distance BB may be in a range of about 2 inches to about 8 inches, or can be in a range of about 3 inches to about 6 inches, or can be in a range of about 3.5 inches to about 4.5 inches, or can be about 4 inches.

In FIG. 7, the snowplow blade 100 is shown lowered into an operating position where the cutting edge 114 is engaging the ground surface. In this position, the blade segment 106 bears the weight of the snowplow blade 100, which compresses each compression member 108. The compression member 108 exerts a downward force on the blade segment 106 to bias the blade segment 106 towards the ground surface such that the cutting edge 114 engages the ground surface. In this example, when the snowplow blade 100 is lowered to its operating position, the lower portion 110 of the blade segment 106 extends a distance CC below the lowermost edge 144 of backing plate 105. The distance CC may be in a range of about 1 inch to about 7 inches, or can be in a range of about 1 inches to about 5 inches, or can be in a range of about 1.5 inches to about 3 inches, or can be about 2.5 inches.

As the snowplow blade 100 is pushed forward by a vehicle over an uneven ground surface, compression member 108 provides down pressure to provide for the cutting edge 114 to follow the contour of the ground surface. The shape of slots 122 of the blade segment 106, as shown in FIGS. 8A and 8B, provide for the blade segment 106 to pivot horizontally and slide vertically relative to the moldboard 101 of the snowplow blade 100 (as previously described).

Figure 10:
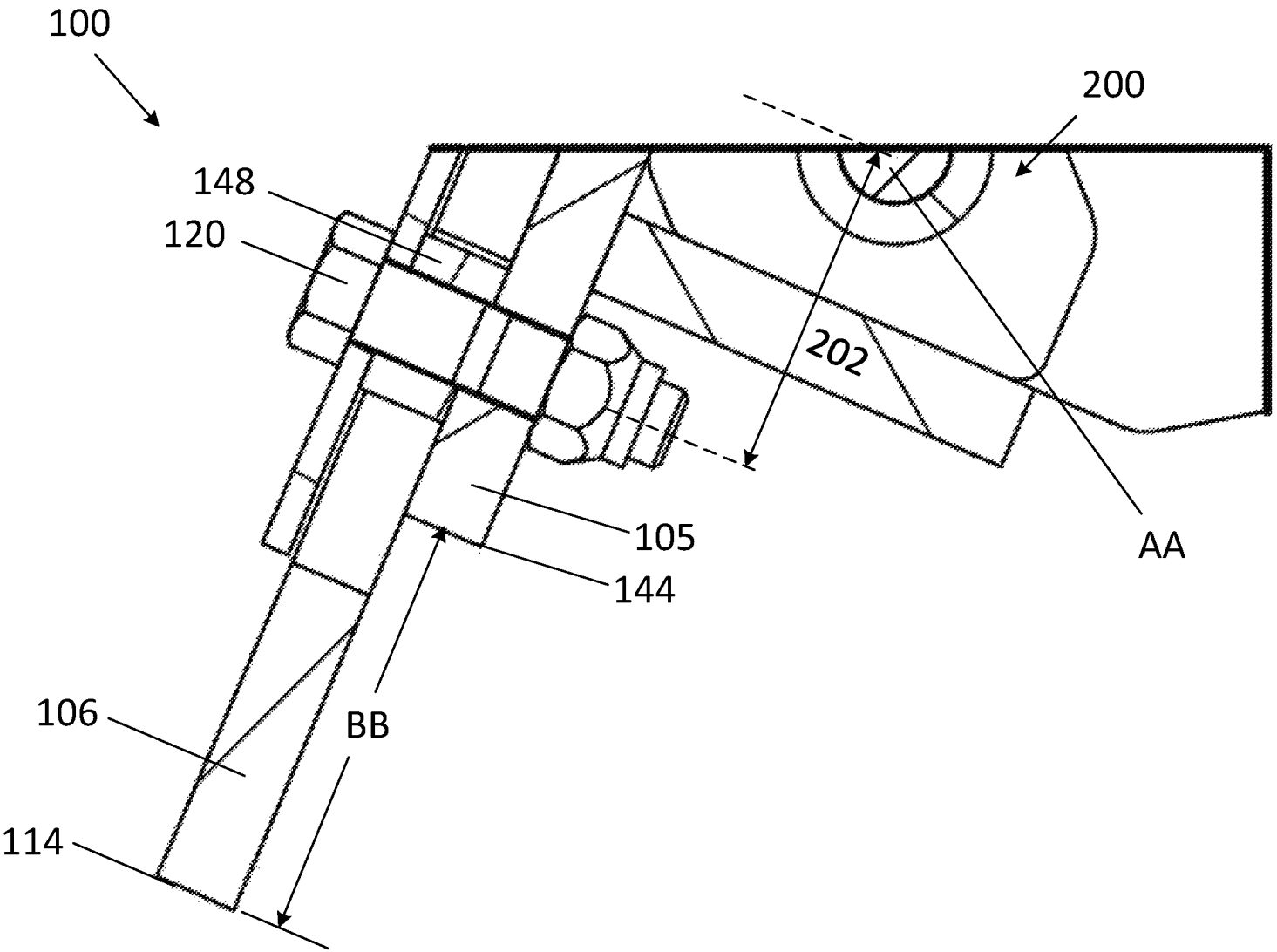
FIG. 10 is a cross-section of the snowplow blade of FIG. 1 with no load on the cutting edge and without forward movement of the plow blade.

FIG. 10 shows a cross-section of the snowplow blade 100 of FIG. 1 without a load being borne by the blade segment 106 and components of the trip cutting edge 200. As shown, compression member 108 biases the blade segment 106 downward and the first portion 110 of the blade segment 106 extends a distance BB below a lowermost edge 144 of a mounting surface 145 of the snowplow blade 100.

As shown in FIG. 10, in the embodiment shown in the Figures with cutting edge mechanism 200, each cutting edge segment 102 is pivotally connected to moldboard 101 and can pivot around a pivot axis AA. The pivot axis AA is substantially parallel to the cutting edge 114 of cutting edge assemblies 102. Pivot axis AA is located at the rear of a front surface of the snowplow blade 100.

Figure 11:
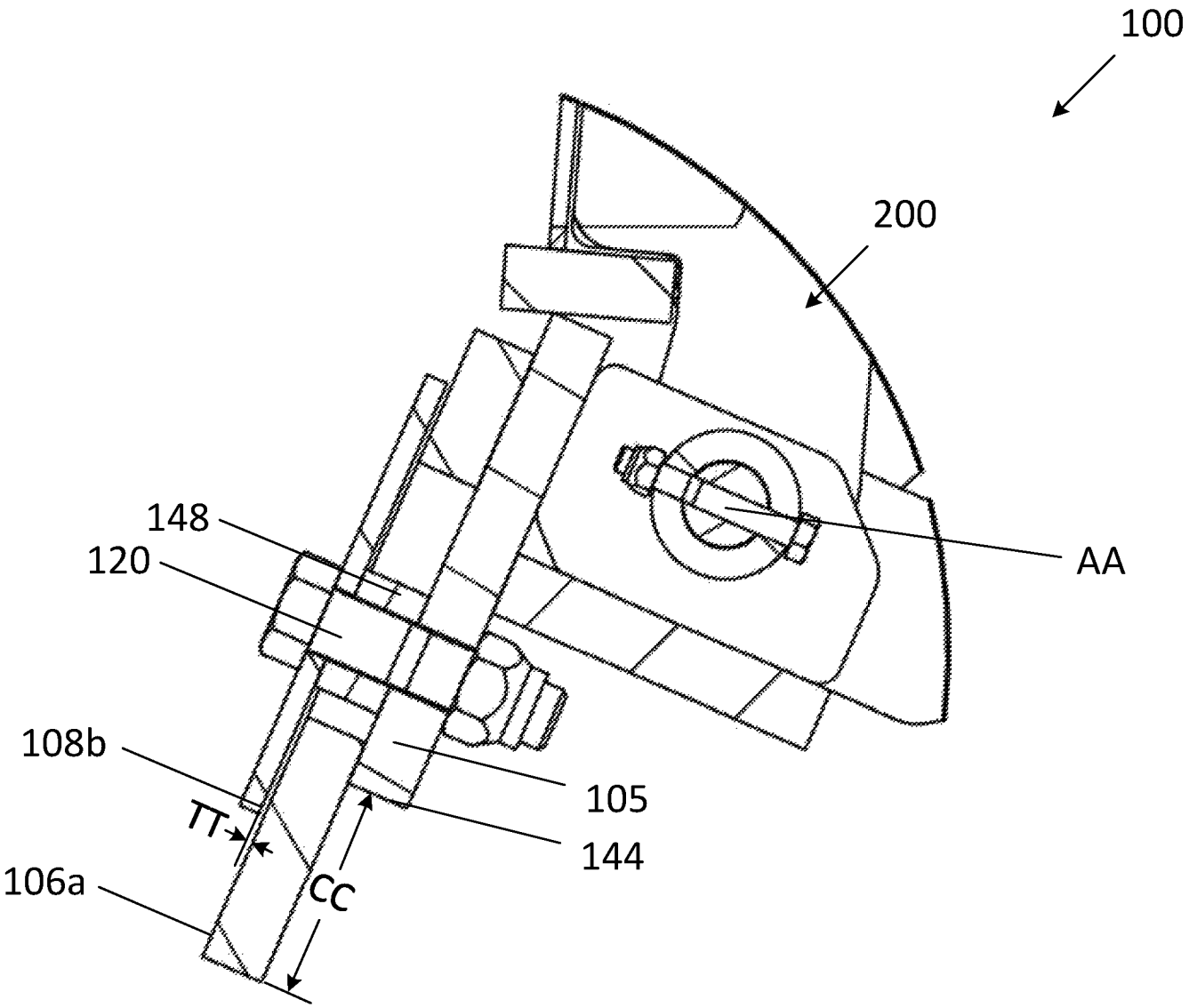
FIG. 11 is a cross-section of the snowplow blade of FIG. 1 with a load on the cutting edge and without forward movement of the plow blade.

FIG. 11 shows a cross-section of the snowplow blade 100 of FIG. 1 with loading on the blade segment 106 (as shown in FIG. 3) but without forward movement of the snowplow blade 100. As shown therein, compression member 108 biases the blade segment 106 downward and the lower portion 110 of the blade segment 106 extends the distance CC below a lowermost edge 144 of backing plate 105 of the snowplow blade 100. Also shown therein, a front face 106*a* of the blade segment 106 may be spaced apart from a rear face 108*b* of the retainer plate 108 by a spacing TT. In some embodiments, spacing TT may be about 1/16 of an inch.

Figure 12:
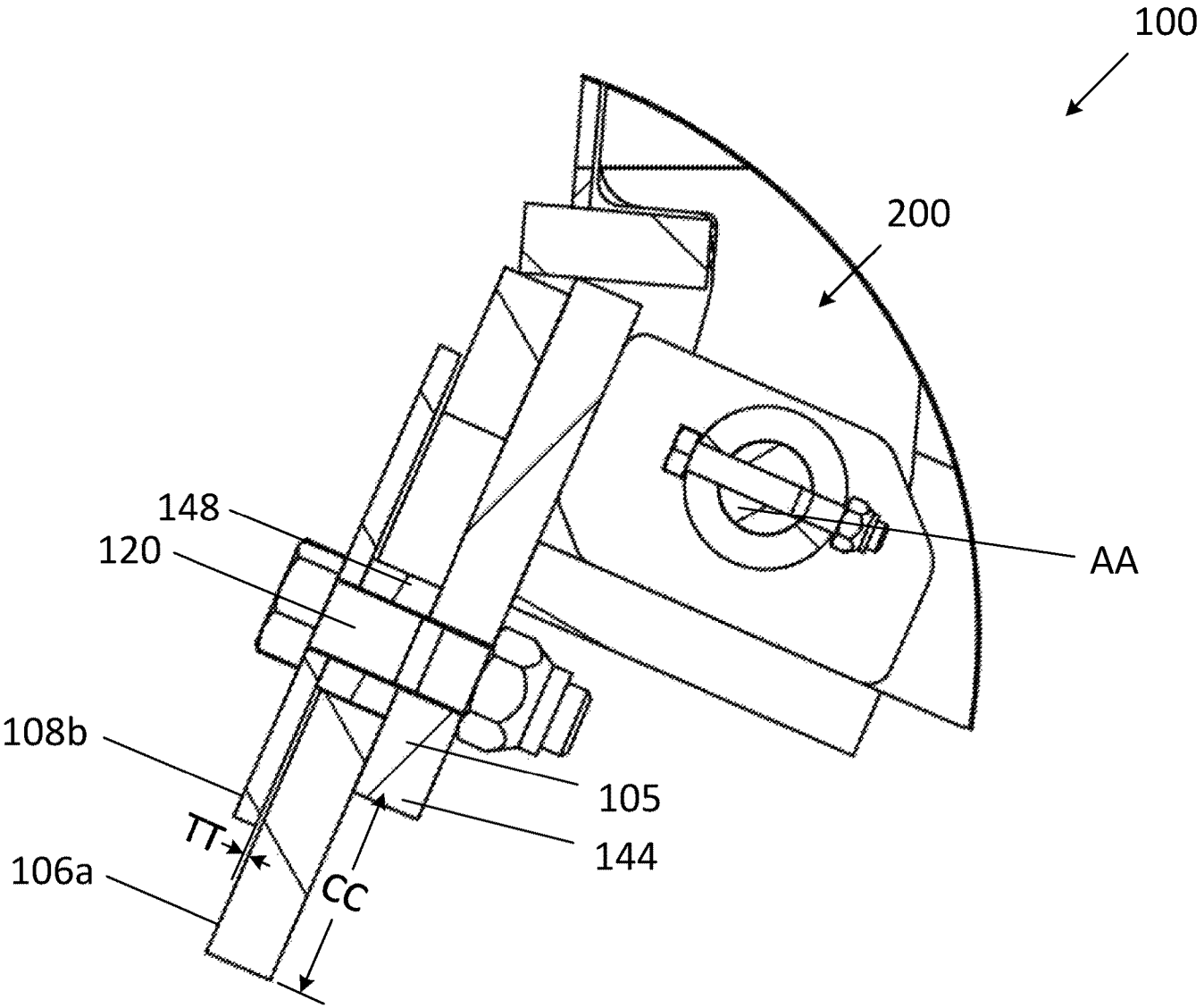
FIG. 12 is a cross-section of the snowplow blade of FIG. 1 with a load on the cutting edge and forward movement of the plow blade.
Figure 13:
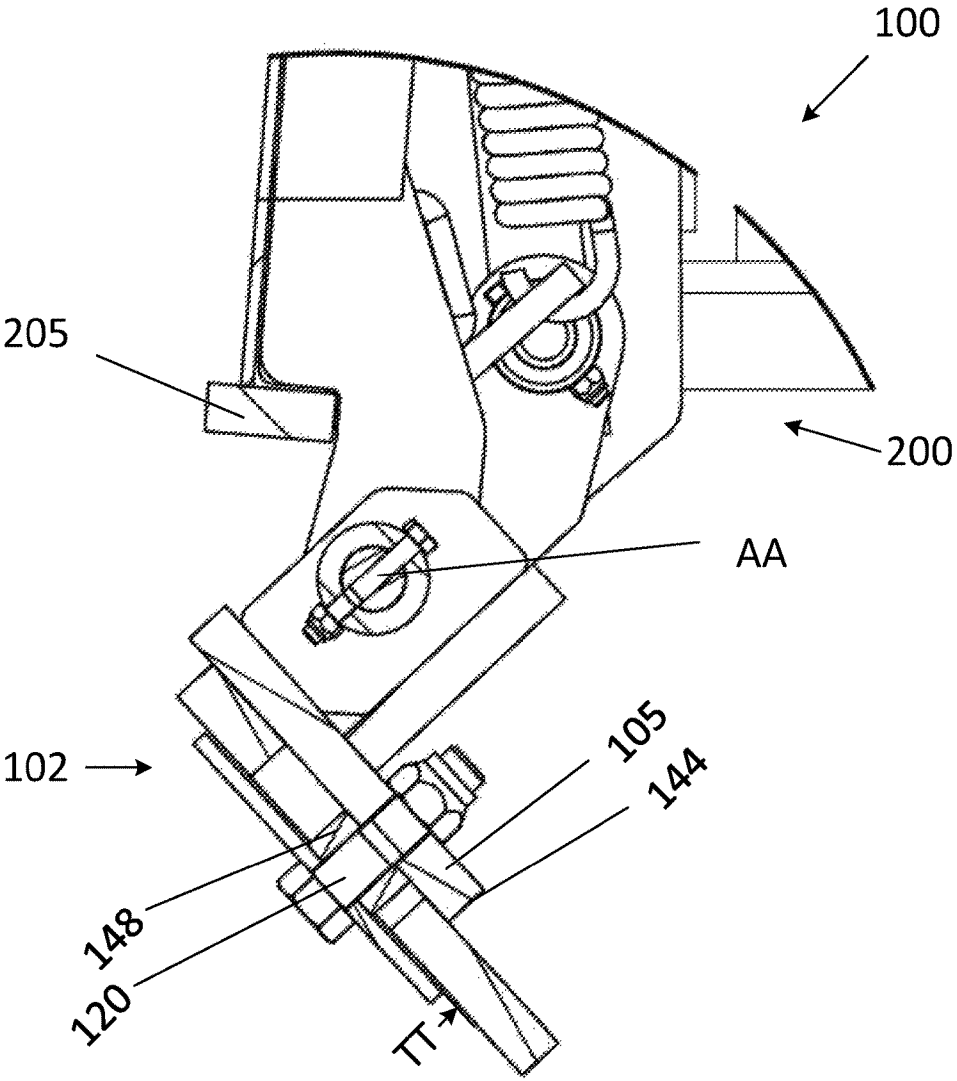
FIG. 13 is a cross-section of the snowplow blade of FIG. 1 both a load on the cutting after an impact situation showing the cutting edge assembly rotated counter-clockwise about an axis against spring pressure.

FIGS. 12 and 13 show the cross-section of FIGS. 1 and 11 with both a load on the blade segment 106 and forward movement of the snowplow blade 100 as in a plowing operation. In FIGS. 12 and 13, the snowplow blade 100 is shown before (FIG. 12) and after (FIG. 13) an impact situation such as but not limited to the snowplow blade 100 striking a large object, where the trip edge mechanism 200 rotates backing plate 105 counter-clockwise about the axis AA against spring pressure until the impact loading is reduced. When the plow blade 100 returns to the operating position, rotation of the backing plate 105 is clockwise until the system 102 rests against a stop plate 205.

Figure 15:
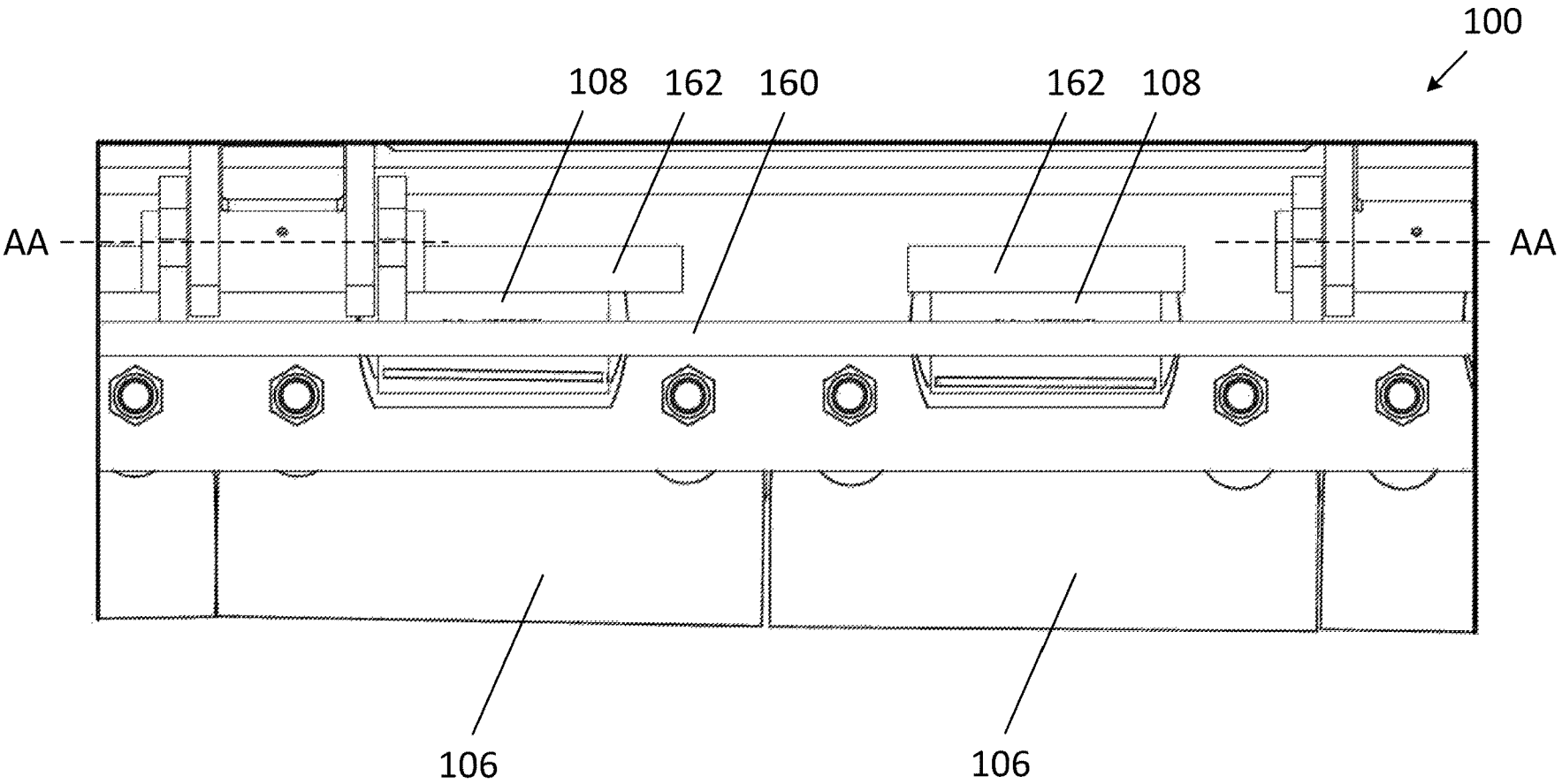
FIG. 15 is a rear view of the backing plate of the snowplow blade of FIG. 1.

In an optional embodiment, FIG. 15 is a rear view of the backing plate 105 of FIG. 1 showing at least one opening 170 registered with and rearward of the compression members 108. Opening 170 in backing plate 105 may provide for snow, slush or other debris (e.g. gravel or stones) to pass through the backing plate 105 and may inhibit collection of snow, slush or other debris behind the blade segment 106, which could inhibit vertical or horizontal movement of blade segment 106 relative to backing plate 105. Opening 107 may be wider than compression member 108.

In some embodiments, a support bar 160 may be coupled to a rear surface 172 of the backing plate 105 and extend across a middle portion of the opening 170 to inhibit rearward movement of the compression member 108 through opening 170. Support bar 160 may be a single bar that extends across a plurality of openings 170 or may only extend across a single opening 170.

In some embodiments, a support member 162 may be coupled to a rear surface 172 of the backing plate 105 above the opening 170 and extend downwardly over at least a portion of the opening 170 to inhibit rearward movement of the compression member 108 through opening 170.

In some embodiments, a lower tab 164 may be coupled to uppermost edge 116 of the intermediate portion 119 of blade segment 106 and extend rearwardly into a portion of the opening 170. Compression member 108 may rest against lower tab 164 which inhibits rearward movement of the compression member 108 through the opening 170.

While the above description provides examples of one or more apparatus, methods, or systems, it will be appreciated that other apparatus, methods, or systems may be within the scope of the claims as interpreted by one of skill in the art.

What is claimed is:

1. A cutting edge system for a snowplow, the system comprising:

- a backing plate coupled to a bottom portion of a moldboard of the snowplow; and
- a plurality of cutting edge segments configured to be mounted to the front surface of the backing plate, each cutting edge segment comprising:
  - a blade segment configured to be slidably mounted to the front surface of the backing plate, the blade segment having:
    - a lower portion having a cutting edge configured to engage a ground surface, and
    - an upper portion having two upwardly extending lobes spaced apart from each other to define an intermediate portion therebetween, the lobes and the intermediate portion forming a pocket, each of the two lobes having a slot configured to receive a fastener to slidably mount the blade segment to the backing plate;
  - a compression member shaped to fit within the pocket and to be retained in between an uppermost edge of the intermediate portion and an engaging surface of the backing plate, the compression member being configured to absorb upward movement of the blade segment when the cutting edge engages the ground surface; and
  - a retainer plate configured to be mounted to the backing plate and cover at least a portion of the blade segment when the blade segment is mounted to the backing plate.

2. The system of claim 1, wherein the compression member has a top portion, a bottom portion opposed to the top portion and two opposed side portions extending between the top and bottom portions, each side being configured to engage a portion of the blade segment.

3. The system of claim 2, wherein the engaging surface is a tab extending outwardly from the backing plate and the top portion of the compression member is configured to engage the tab.

4. The system of claim 3, wherein the blade segment includes a lower flat bar tab coupled to the upper portion of the blade segment and the bottom portion of the compression member is configured to engage the lower flat bar tab.

5. The system of claim 3, wherein at least a portion of the uppermost edge of the intermediate portion is parallel with the tab of the backing plate.

6. The system of claim 5, wherein the uppermost edge of the intermediate portion extends along a width of the blade segment between the two slots.

7. The system of claim 6, wherein the uppermost edge of the intermediate portion is parallel with the cutting edge.

8. The system of claim 1, wherein the two slots are spaced apart from each other along a width of the blade segment and each slot has a perimeter that is greater than a perimeter of a respective fastener.

9. The system of claim 8, wherein each of the two slots has a height that is greater than a height of its respective fastener to provide for upward movement of the blade segment relative to the backing plate when the cutting edge engages the ground surface.

10. The system of claim 1 further comprising a plurality of bushings, each bushing configured to engage a respective fastener within one of the slots and extend outwardly beyond a front surface of the blade segment when the blade segment is slidably mounted to the backing plate.

11. The system of claim 10, wherein each cutting edge segment is horizontally spaced from an adjacent cutting edge segment and each slot has a width that is greater than a width of each fastener and bushing when the fastener and bushing are received in the slot to provide for each blade segment to be pivotable about at least one of the fasteners.

12. The system of claim 11, wherein at least a portion of an inner side of each slot extends inwardly towards an opposed slot to provide for the width of the slot to be greater than the width of each fastener and bushing when the fastener and bushing are received in the slot.

13. The system of claim 1, wherein the backing plate includes a plurality of openings, each opening positioned rearwardly of one of the compression members.

14. The system of claim 13, wherein the engaging surface is a tab extending from the backing plate and the top portion of the compression member is configured to engage the tab.

15. The system of claim 14, wherein the blade segment includes a lower flat bar tab coupled to the upper portion of the blade segment and the bottom portion of the compression member is configured to engage the lower flat bar tab.

16. The system of claim 1, wherein the backing plate is pivotally coupled to the bottom portion of the moldboard and configured to rotate rearwardly upon the snowplow blade striking an obstruction during operation.

17. The system of claim 16, wherein the backing plate includes a right backing plate segment and a left backing plate segment, each backing plate segment being independently rotatable in a rearward direction upon the snowplow striking an obstruction during operation.

18. The system of claim 1, wherein the compression member is shaped to not engage with an uppermost edge of each of the lobes.

19. A cutting edge segment configured to be mounted to a front surface of a backing plate of a snowplow, the cutting edge segment comprising:

a blade segment configured to be slidably mounted to the front surface of the backing plate, the blade segment having:

a lower portion having a cutting edge configured to engage a ground surface, and an upper portion having two upwardly extending lobes spaced apart from each other to define an intermediate portion therebetween, the lobes and the intermediate portion forming a pocket, each of the two lobes having a slot configured to receive a fastener to slidably mount the blade segment to the backing plate;

a compression member shaped to fit within the pocket and to be retained in between an uppermost edge of the intermediate portion and an engaging surface of the backing plate, the compression member being configured to absorb upward movement of the blade segment when the cutting edge engages the ground surface; and a retainer plate configured to be mounted to the backing plate and cover at least a portion of the blade segment when the blade segment is mounted to the backing plate.

20. A snowplow comprising:

a moldboard;

a backing plate coupled to a bottom portion of the moldboard; and a plurality of cutting edge segments configured to be mounted to the front surface of the backing plate, each cutting edge segment comprising:

a blade segment configured to be slidably mounted to the front surface of the backing plate, the blade segment having:

a lower portion having a cutting edge configured to engage a ground surface, and an upper portion having two upwardly extending lobes spaced apart from each other to define an intermediate portion therebetween, the lobes and the intermediate portion forming a pocket, each of the two lobes having a slot configured to receive a fastener to slidably mount the blade segment to the backing plate;

a compression member shaped to fit within the pocket and to be retained in between an uppermost edge of the intermediate portion and an engaging surface of the backing plate, the compression member being configured to absorb upward movement of the blade segment when the cutting edge engages the ground surface; and a retainer plate configured to be mounted to the backing plate and cover at least a portion of the blade segment when the blade segment is mounted to the backing plate.

* * * * *